US007589696B2

(12) United States Patent
Hashimoto et al.

(10) Patent No.: US 7,589,696 B2
(45) Date of Patent: Sep. 15, 2009

(54) PLASMA DISPLAY PANEL APPARATUS PERFORMING IMAGE DISPLAY DRIVE USING DISPLAY METHOD THAT INCLUDES WRITE PERIOD AND SUSTAIN PERIOD, AND DRIVING METHOD FOR THE SAME

(75) Inventors: Shinichiro Hashimoto, Toyonaka (JP); Masatoshi Kitagawa, Hirakata (JP); Yukihiro Morita, Hirakata (JP); Naoki Kosugi, Kyoto (JP)

(73) Assignee: Panasonic Corporation, Osaka (JP)

( * ) Notice: Subject to any disclaimer, the term of this patent is extended or adjusted under 35 U.S.C. 154(b) by 784 days.

(21) Appl. No.: 10/533,840

(22) PCT Filed: Nov. 13, 2003

(86) PCT No.: PCT/JP03/14416

§ 371 (c)(1),
(2), (4) Date: May 4, 2005

(87) PCT Pub. No.: WO2004/051613

PCT Pub. Date: Jun. 17, 2004

(65) Prior Publication Data

US 2006/0033681 A1 Feb. 16, 2006

(30) Foreign Application Priority Data

Nov. 29, 2002 (JP) ..... 2002-348539

(51) Int. Cl.
*G09G 3/28* (2006.01)

(52) U.S. Cl. ..... 345/60

(58) Field of Classification Search ..... 345/60–63, 345/68; 315/169.1, 169.3
See application file for complete search history.

(56) References Cited

U.S. PATENT DOCUMENTS

| | | | | |
|---|---|---|---|---|
| 5,661,500 | A * | 8/1997 | Shinoda et al. | 345/60 |
| 5,990,630 | A * | 11/1999 | Nakamura | 315/169.4 |
| 6,376,995 | B1 | 4/2002 | Kato et al. | |
| 6,621,229 | B2 * | 9/2003 | Kanazawa et al. | 315/169.3 |
| 2003/0042855 | A1 * | 3/2003 | Chien et al. | 313/586 |

FOREIGN PATENT DOCUMENTS

| | | |
|---|---|---|
| JP | 10-133622 | 5/1998 |
| JP | 11-149274 | 6/1999 |
| JP | 2000-194317 | 7/2000 |
| JP | 2000-259123 | 9/2000 |
| JP | 2001-265281 | 9/2001 |
| WO | WO 98/21706 | 5/1998 |

* cited by examiner

*Primary Examiner*—Richard Hjerpe
*Assistant Examiner*—Shaheda A Abdin

(57) ABSTRACT

The present invention aims to provide a PDP apparatus and a driving method for the same which can improve display quality by reducing a peak value of a discharge current flowing in scan and sustain electrodes in a sustain period, without an increase in manufacturing cost. This is achieved as follows. A driving unit 20 applies a sustain data pulse 320 to a plurality of third electrodes in a sustain period $T_3$. Here, a voltage waveform of the sustain data pulse 320 starts to rise after a voltage of each of pulses 300 and 310 applied to a pair of a scan electrode SCN and a sustain electrode SUS reaches a predetermined level. Furthermore, the sustain data pulse 320 rises at a different timing at least from a sustain data pulse 320 applied to an adjacent data electrode.

38 Claims, 12 Drawing Sheets

PLASMA DISPLAY PANEL APPARATUS PERFORMING IMAGE DISPLAY DRIVE USING DISPLAY METHOD THAT INCLUDES WRITE PERIOD AND SUSTAIN PERIOD, AND DRIVING METHOD FOR THE SAME

TECHNICAL FIELD

The present invention relates to a plasma display panel (PDP) apparatus and a driving method for the same. The present invention particularly relates to a technique to enhance luminous efficiency while reducing an increase in cost of the apparatus.

BACKGROUND ART

PDP apparatuses have relative ease in increasing a screen size, when compared with CRT display apparatuses which are currently most common image display apparatuses. Therefore, PDP apparatuses attract attention as image display apparatuses suitable for high-definition broadcasting. Here, PDP apparatuses can be classified into alternating current (AC) and direct current (DC) types. At present, AC-type PDP apparatuses form a mainstream because of their superiority in a variety of aspects such as reliability and display quality. (Hereinafter, the term PDP apparatus refers to AC types.)

A PDP apparatus is constituted by a panel unit and a driving unit. The panel unit includes a front panel in which a plurality of pairs of a scan electrode and a sustain electrode are provided, and a back panel on which a plurality of data electrodes are provided. The front panel and the back panel are arranged so as to oppose each other with a space therebetween. Here, the front panel and the back panel are aligned so that the data electrodes intersect the scan electrodes and the sustain electrodes. The front panel and the back panel are sealed together at their peripheral portions. Furthermore, a rare gas such as Ne, Xe and He is enclosed in the space (a discharge space) between the front and back panels. In this way, discharge cells are formed at areas where the data electrodes intersect the scan and sustain electrodes.

This PDP apparatus is generally driven using a field time-sharing gradation display method. According to this method, one field (one frame) is divided into a plurality of sub-fields each of which includes a write period and a sustain period. In this way, a duration of lighting is time-divided. Furthermore, images of the sub-fields are combined, to express a gray-scale image for the field.

Regarding such PDP apparatuses, there is a demand for a larger screen and higher definition. To meet this demand, it is required to further reduce degradation in display quality due to electric resistances of scan electrodes and sustain electrodes on a front panel. In detail, since the scan electrodes and the sustain electrodes are usually disposed so as to extend in a lengthwise direction of the front panel, an increase in size of the front panel particularly tends to cause an increase in resistance of the scan and sustain electrodes. Consequently, when electric currents are supplied to the scan and sustain electrodes to drive a PDP apparatus, a significant voltage drop occurs, and the display quality is degraded. This is particularly noticeable in a sustain period. In the sustain period, a discharge current $E_0$ flows in each discharge cell in a very short time period of approximately several hundred nanoseconds from a start of a discharge, as shown in FIG. 11. The sum of the amounts of discharge currents $E_0$ flowing in all of the discharge cells formed by the individual scan and sustain electrodes is equal to the amount of a current $Et_0$ flowing in the individual scan and sustain electrodes, as shown in FIG. 12. As a result, a noticeable voltage drop occurs in the scan and sustain electrodes. This results in lower display quality of the PDP apparatus.

To prevent such a voltage drop of scan and sustain electrodes in a sustain period, it has been considered and attempted to differentiate discharge cells in terms of discharge start timing. For example, Japanese patent application publication No. H11-149274 discloses a driving method in which a pulse is applied to data electrodes forming selected discharge cells in a sustain period. This pulse rises before pulses are applied to scan and sustain electrodes, and falls immediately after a discharge caused by the pulses applied to the scan and sustain electrodes is completed. According to this technique, a discharge starts at a different timing between in the selected discharge cells and remaining not-selected discharge cells. This prevents a large current from flowing into the scan and sustain electrodes in a short time, thereby reducing occurrence of a voltage drop.

In addition, Japanese patent application publication No. H10-133622 discloses the following driving method. In a sustain period, each data electrode is set to a different potential, or data electrodes are grouped so that each group of data electrodes is set at a different potential. According to this technique, a discharge starts at a different timing among discharge cells, or discharge cell groups corresponding to the data electrode groups. This lowers a peak value of discharge currents flowing into scan and sustain electrodes in the sustain period.

As described above, driving of a PDP apparatus is controlled, by means of two options of whether or not to apply the pulse to the data electrodes (Japanese patent application publication No. H11-149264), or by means of two options of whether to apply a pulse of high or low potential (Japanese patent application publication No. H10-133622). According to these techniques, discharge currents in the scan and sustain electrodes are divided into only two groups. Therefore, only little effect is achieved by differentiating discharge currents. The effect can possibly be improved by increasing the number of potential levels for pulses applied to data electrodes, based on the technical idea disclosed in the latter patent application publication. However, an increase in number of potential levels causes an increase in number of necessary power sources. This increase leads to a higher manufacturing cost of a driving unit and unevenness of luminance among discharge cells. For this reason, this alternative method is hardly realistic.

DISCLOSURE OF THE INVENTION

In light of the above-described problems, an objective of the present invention is to provide a PDP apparatus and a driving method for the same which attain enhanced display quality by lowering a peak value of discharge currents flowing in scan and sustain electrodes in a sustain period, without increasing a manufacturing cost of the apparatus.

To achieve this objective, the present invention has the following characteristics.

(1) A PDP apparatus comprising a panel unit and a driving unit, the panel unit including a first substrate on which a plurality of pairs of first and second electrodes are formed and a second substrate on which a plurality of third electrodes are formed, the first substrate and the second substrate being opposed to each other with a discharge space therebetween so as to form discharge cells at areas where the plurality of pairs of first and second electrodes intersect the plurality of third electrodes, the driving unit driving the panel unit to display an image according to a display method that includes a write period and a sustain period, by, in the sustain period, applying a voltage to the plurality of pairs of first and second electrodes and applying a voltage to the plurality of third electrodes, the PDP apparatus being characterized in that in the sustain period, voltage waveforms applied to the plurality of third electrodes differ in terms of a rise start timing which is set relative to a time at which the voltage applied to the plurality of pairs of first and second electrodes reaches a predetermined level.

According to this PDP apparatus, the voltage waveforms differ in terms of rise start timing, among the plurality of third electrodes. This can differentiate a sustain discharge in terms of start timing, among the third electrodes. Thus, currents flowing in the first and second electrodes can differ in terms of peak time in the sustain period. As a result, occurrence of a voltage drop in the first and second electrodes can be prevented.

According to this PDP apparatus, in addition, the voltage waveforms differ among the plurality of third electrodes in terms of rise start timing. This can cause sustain discharges to occur at different timings. Therefore, discharge currents can differ at many levels in terms of peak time without increasing the number of power sources.

As a consequence, the PDP apparatus can reduce the voltage drop, by lowering a peak value of the discharge currents flowing in the first and second electrodes in the sustain period, thereby attaining high display quality without an increase in cost.

Here, the voltage is not necessarily applied to all of the plurality of third electrodes in the sustain period, but may be applied to selected ones of the plurality of third electrodes. Moreover, the voltage waveforms applied in the sustain period may differ in terms of rise start timing, among all of the third electrodes, or between a group of selected electrodes and a group of remaining not-selected electrodes.

(2) The PDP apparatus of (1), wherein the plurality of third electrodes are divided into a plurality of groups each of which includes two or more third electrodes, and in the sustain period, the driving unit controls the rise start timing in units of groups.

(3) The PDP apparatus of (2), wherein the driving unit includes: a plurality of voltage applying circuit units which apply the voltage to the plurality of third electrodes in the sustain period; and a timing signal generation unit that outputs a signal indicating the rise start timing, in the sustain period, to each of the plurality of voltage applying circuit units.

(4) The PDP apparatus of (1), wherein in the sustain period, the driving unit controls the voltage waveforms applied to the plurality of third electrodes so as to start rising within a time period shorter than a half cycle of a waveform of the voltage applied to the plurality of pairs of first and second electrodes.

(5) The PDP apparatus of (4), wherein in the sustain period, the driving unit controls the voltage waveforms applied to the plurality of third electrodes so as to start rising, after a time at which the voltage applied to the plurality of pairs of first and second electrodes reaches a predetermined level, but before a time at which a discharge is generated by the voltage applied to the plurality of pairs of first and second electrodes when the voltage is assumed not to be applied to the plurality of third electrodes.

(6) The PDP apparatus of (5), wherein in the sustain period, a voltage waveform applied to a first electrode and a voltage waveform applied to a second electrode paired with the first electrode have a same cycle, but are different from each other in terms of a timing of application, by half the cycle.

(7) The PDP apparatus of (1), wherein in the sustain period, a voltage waveform applied to at least one of the plurality of third electrodes starts to fall at a different timing, from a voltage waveform applied to an adjacent third electrode, which is set relative to a time at which the voltage applied to the plurality of pairs of first and second electrodes reaches a predetermined level.

(8) The PDP apparatus of (7), wherein in the sustain period, the driving unit controls the voltage waveforms applied to the plurality of third electrodes so as to start falling within a time period shorter than a half cycle of a waveform of the voltage applied to the plurality of pairs of first and second electrodes.

(9) The PDP apparatus of (1), wherein when the voltage waveforms applied to the plurality of third electrodes in the sustain period are expressed using a time axis and a voltage axis, at least one of a rising portion and a falling portion of each of the voltage waveforms has a gradient, and a voltage waveform applied to at least one of the plurality of third electrodes has a different gradient for at least one of a rising portion and a falling portion, from a waveform applied to an adjacent third electrode.

(10) The PDP apparatus of (9), wherein a duration of at least one of the rising portion and the falling portion of the voltage waveform is shorter than a half cycle of a waveform of the voltage applied to the plurality of pairs of first and second electrodes.

(11) The PDP apparatus of (1), wherein each of the voltage waveforms applied the plurality of third electrodes in the sustain period is a pulse waveform of a substantially same width.

(12) The PDP apparatus of (1), wherein the driving unit drives the panel unit by repeating a sub-field including the write period and the sustain period, and the driving unit controls the rise start timing in units of sub-fields.

(13) The PDP apparatus of (12), wherein two or more sub-fields constitute a sub-field group, and the driving unit controls the rise start timing in units of sub-field groups.

(14) The PDP apparatus of (1), wherein the driving unit drives the panel unit by repeating a sub-field including the write period and the sustain period, and a plurality of sub-fields constitute a field, and the driving unit controls the rise start timing in units of fields.

(15) The PDP apparatus of (14), wherein two or more fields constitute a field group, and the driving unit controls the rise start timing in units of field groups.

(16) The PDP apparatus of (1), wherein the write period and the sustain period constitute a sub-field, and a plurality of sub-fields constitute a field, and for each of the voltage waveforms applied to the plurality of third electrodes, an average time period, in each sub-field or field, from a time at which the voltage applied to the plurality of pairs of first and second electrodes reaches a predetermined level to a time at which the voltage applied to the plurality of third electrodes starts to rise is substantially same.

(17) The PDP apparatus of (1), wherein in the sustain period, a cycle of the voltage waveforms applied to the plurality of third electrodes is equal to a half cycle of a waveform of the voltage applied to the plurality of pairs of first and second electrodes.

(18) The PDP apparatus of (1), wherein in the sustain period, a cycle of the voltage waveforms applied to the plurality of third electrodes is equal to a cycle of a waveform of the voltage applied to the plurality of pairs of first and second electrodes.

(19) The PDP apparatus of (1), wherein in the sustain period, a cycle of the voltage waveforms applied to the plurality of third electrodes is equal to an integral multiple of a cycle of a waveform of the voltage applied to the plurality of pairs of first and second electrodes.

(20) A driving method for a PDP apparatus including a panel unit including a first substrate on which a plurality of pairs of first and second electrodes are formed and a second substrate on which a plurality of third electrodes are formed, the first substrate and the second substrate being opposed to each other with a discharge space therebetween so as to form discharge cells at areas where the plurality of pairs of first and second electrodes intersect the plurality of third electrodes, the driving method including a write period and a sustain period, and being used to display an image, by, in the sustain period, applying a voltage to the plurality of pairs of first and second electrodes and applying a voltage to the plurality of third electrodes, the driving method being characterized in that in the sustain period, voltage waveforms applied to the plurality of third electrodes differ in terms of a rise start timing which is set relative to a time at which the voltage applied to the plurality of pairs of first and second electrodes reaches a predetermined level.

According to this driving method, the voltage drop can be reduced, by lowering a peak value of the discharge currents flowing in the first and second electrodes in the sustain period, thereby attaining high display quality without an increase in cost of the PDP apparatus.

(21) The driving method of (20), wherein the plurality of third electrodes are divided into a plurality of groups each of which includes two or more third electrodes, and in the sustain period, the rise start timing is controlled in units of groups.

(22) The driving method of (21), wherein a voltage applying circuit that applies a voltage is connected to each of the plurality of groups of third electrodes, and in the sustain period, the rise start timing is controlled in such a manner that a signal indicating the rise start timing is input into the voltage applying circuit.

(23) The driving method of (20), wherein in the sustain period, the voltage waveforms applied to the plurality of third electrodes are controlled so as to start rising within a time period shorter than a half cycle of a waveform of the voltage applied to the plurality of pairs of first and second electrodes.

(24) The driving method of (23), wherein in the sustain period, the voltage waveforms applied to the plurality of third electrodes are controlled so as to start rising, after a time at which the voltage applied to the plurality of pairs of first and second electrodes reaches a predetermined level, but before a time at which a discharge is generated by the voltage applied to the plurality of pairs of first and second electrodes when the voltage is assumed not to be applied to the plurality of third electrodes.

(25) The driving method of (24), wherein in the sustain period, a voltage waveform applied to a first electrode and a voltage waveform applied to a second electrode paired with the first electrode have a same cycle, but are different from each other in terms of a timing of application, by half the cycle.

(26) The driving method of (20), wherein in the sustain period, a voltage waveform applied to at least one of the plurality of third electrodes starts to fall at a different timing, from a voltage waveform applied to an adjacent third electrode, which is set relative to a time at which the voltage applied to the plurality of pairs of first and second electrodes reaches a predetermined level.

(27) The driving method of (26), wherein in the sustain period, the voltage waveforms applied to the plurality of third electrodes are controlled so as to start falling within a time period shorter than a half cycle of a waveform of the voltage applied to the plurality of pairs of first and second electrodes.

(28) The driving method of (20), wherein when the voltage waveforms applied to the plurality of third electrodes in the sustain period are expressed using a time axis and a voltage axis, at least one of a rising portion and a falling portion of each of the voltage waveforms has a gradient, and a voltage waveform applied to at least one of the plurality of third electrodes has a different gradient for at least one of a rising portion and a falling portion, from a waveform applied to an adjacent third electrode.

(29) The driving method of (28), wherein a duration of at least one of the rising portion and the falling portion of the voltage waveform is shorter than a half cycle of a waveform of the voltage applied to the plurality of pairs of first and second electrodes.

(30) The driving method of (20), wherein each of the voltage waveforms applied the plurality of third electrodes in the sustain period is a pulse waveform of a substantially same width.

(31) The driving method of (20), wherein the panel unit is driven by repeating a sub-field including the write period and the sustain period, and the rise start timing is controlled in units of sub-fields.

(32) The driving method of (31), wherein two or more sub-fields constitute a sub-field group, and the rise start timing is controlled in units of sub-field groups.

(33) The driving method of (20), wherein the panel unit is driven by repeating a sub-field including the write period and the sustain period, and a plurality of sub-fields constitute a field, and the rise start timing is controlled in units of fields.

(34) The driving method of (33), wherein two or more fields constitute a field group, and the rise start timing is controlled in units of field groups.

(35) The driving method of (20), wherein the write period and the sustain period constitute a sub-field, and a plurality of sub-fields constitute a field, and for each of the voltage waveforms applied to the plurality of third electrodes, an average time period, in each sub-field or field, from a time at which the voltage applied to the plurality of pairs of first and second electrodes reaches a predetermined level to a time at which the voltage applied to the plurality of third electrodes starts to rise is substantially same.

(36) The driving method of (20), wherein in the sustain period, a cycle of the voltage waveforms applied to the plurality of third electrodes is equal to a half cycle of a waveform of the voltage applied to the plurality of pairs of first and second electrodes.

(37) The driving method of (20), wherein in the sustain period, a cycle of the voltage waveforms applied to the plurality of third electrodes is equal to a cycle of a waveform of the voltage applied to the plurality of pairs of first and second electrodes.

(38) The driving method of (20), wherein in the sustain period, a cycle of the voltage waveforms applied to the plurality of third electrodes is equal to an integral multiple of a cycle of a waveform of the voltage applied to the plurality of pairs of first and second electrodes.

BEST MODE FOR CARRYING OUT THE INVENTION

First Embodiment

1-1 Construction of Panel Unit 10

The following describes a PDP apparatus 1 relating to a first embodiment. To start with, a construction of a panel unit 10 in the PDP apparatus 1 is described with reference to FIG. 1. It should be noted that the PDP apparatus 1 is AC-type.

Figure 1:
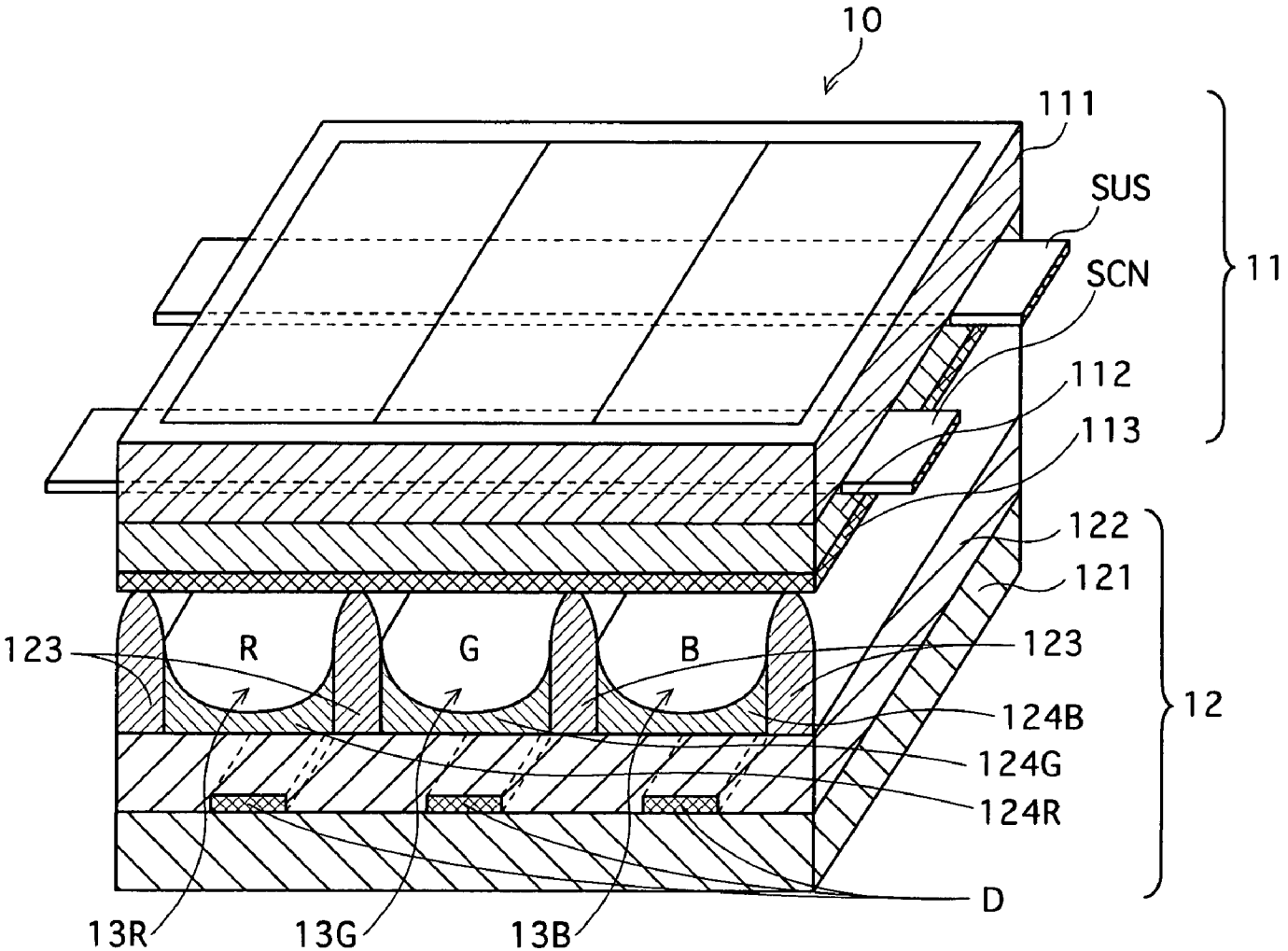
FIG. 1 is a perspective view illustrating (partly illustrating a cross-section of) a main part of a panel unit 10 of a PDP apparatus 1 relating to a first embodiment.

As shown in FIG. 1, the panel unit 10 is constituted by a front panel 11 and a back panel 12 which are placed so as to oppose each other with a space therebetween. A plurality of scan electrodes SCN and a plurality of sustain electrodes SUS are alternately arranged in stripes on a front substrate 111 in the front panel 11. Note that the scan electrodes SCN and the sustain electrodes SUS may be sometimes collectively referred to as display electrodes hereinafter. A dielectric layer 112 is formed on the entire surface of the front substrate 111 on which the display electrodes SCN and SUS are formed. A protective layer 113 is formed on the dielectric layer 112.

On the other hand, a plurality of data electrodes D are arranged in stripes on a back substrate 121 in the back panel 12. A dielectric layer 122 is formed on a surface of the back substrate 121 on which the data electrodes D are formed. A plurality of barrier ribs 123 are provided so as to protrude between adjacent data electrodes D, in parallel to the data electrodes D, on the dielectric layer 122. A red phosphor layer 124R, a green phosphor layer 124G and a blue phosphor layer 124B are formed on the Walls and bottom of grooves defined by the dielectric layer 122 and adjacent barrier ribs 123.

The front panel 11 and the back panel 12 are opposed to each other in such a manner that the protective layer 113 is faced to the phosphor layers 124R, 124G and 124B, and so that the display electrodes SCN and SUS intersect the data electrodes D in the panel unit 10. Furthermore, the front panel 11 and the back panel 12 are sealed at their peripheral portions using a glass frit. A discharge gas including inert gas components such as helium (He), xenon (Xe) and neon (Ne) is enclosed in the space (a discharge space) between the front panel 11 and the back panel 12, at a predetermined pressure of approximately 53.2 kPa to 79.8 kPa.

In this panel unit 10, an area where a scan electrode SCN and a sustain electrode SUS intersect a data electrode D forms each discharge cell in relation to image display.

Since a typical material is used to form each constituent of the panel unit 10 in the PDP apparatus 1 relating to the first embodiment, a material for each constituent is not explained. There is not particular limitation to the size of the panel unit 10, but an example size is provided in the following. To realize a VGA in the 40-inch range using the panel unit 10, a cell pitch of 1080 μm and a cell pitch of 360 μm are required, and the size of one pixel composed of adjacent red, green and blue discharge cells is required to be 1080 μm×1080 μm.

1-2 Construction of the PDP Apparatus 1

Figure 2:
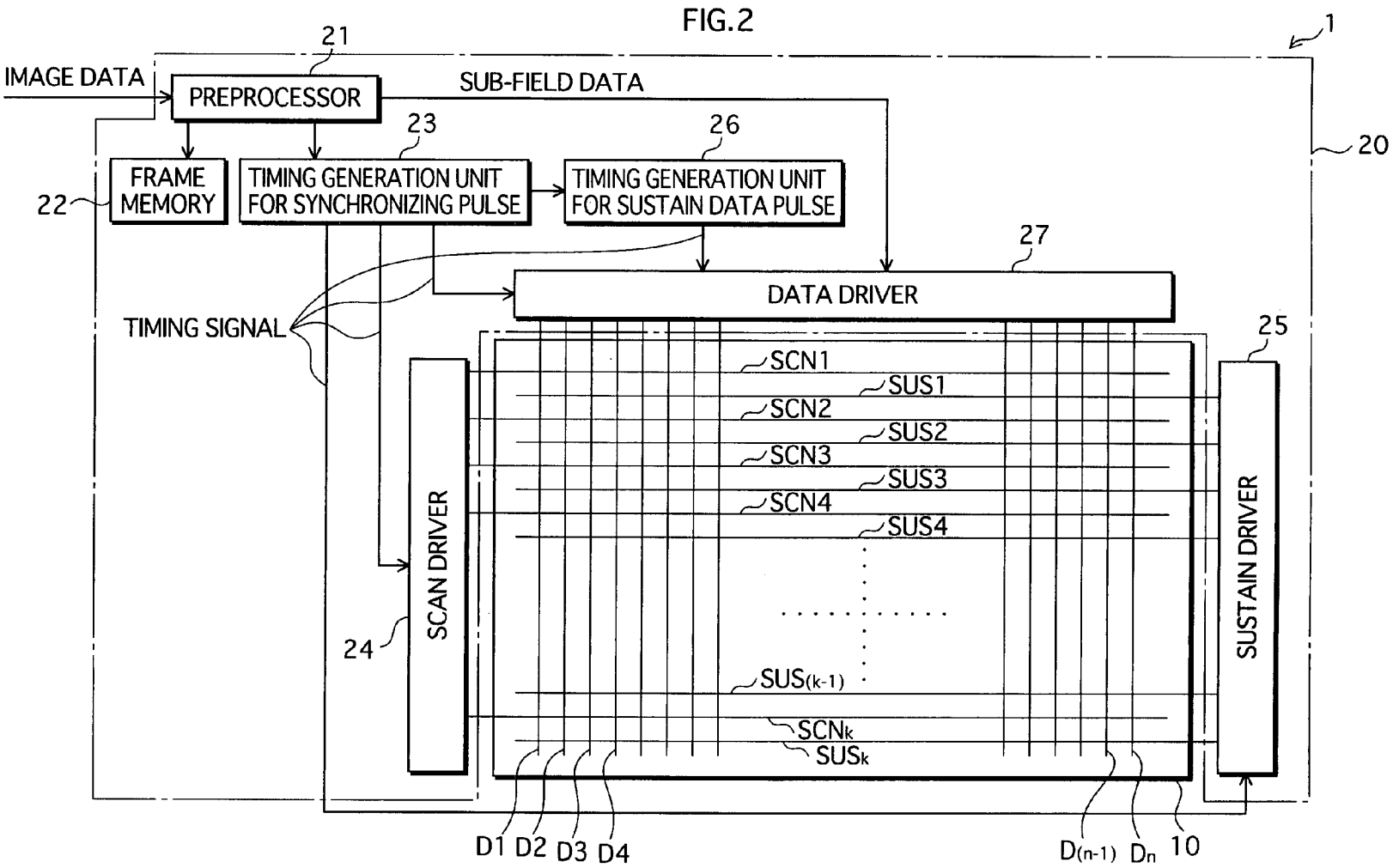
FIG. 2 is a block diagram illustrating a circuit structure of the PDP apparatus 1 relating to the first embodiment.

The following describes a construction of the PDP apparatus 1 including the panel unit 10, with reference to FIG. 2 which is a block diagram illustrating the construction of the PDP apparatus 1.

As shown in FIG. 2, the PDP apparatus 1 relating to the first embodiment is constituted by the panel unit 10 and a driving unit 20. The driving unit 20 drives the panel unit 10 using a field timesharing gradation display method, to display a gray-scale image.

The driving unit 20 is constituted by a preprocessor 21, a frame memory 22, a timing generation unit 23 for a synchronizing pulse, a scan driver 24, a sustain driver 25, a timing generation unit 26 for a sustain data pulse, and a data driver 27.

The preprocessor 21 extracts image data for each field (field data) from image data input thereto, and generates image data for each sub-field (sub-field data) from the extracted field data. The preprocessor 21 stores the generated sub-field data in the frame memory 22. Also, the preprocessor 21 extracts line-by-line data from current sub-field data stored in the frame memory 22, and outputs the extracted data to the data driver 27. Furthermore, the preprocessor 21 extracts a synchronizing signal such as a horizontal synchronizing signal and a vertical synchronizing signal from image data input thereto, and sends a timing signal, for each field or sub-field, to the timing generation unit 23.

The frame memory 22 is a two-port frame memory including two memory areas each of which can store one piece of field data (for example, eight pieces of sub-field data). In this way, while sub-filed data is being written into one of the memory areas, sub-field data written in the other memory area is being read. Here, writing and reading operations alternate in each of the memory areas.

The timing generation unit 23 generates a timing signal to raise each of a set-up pulse, a scan pulse and a sustain pulse, based on the timing signal received from the preprocessor 21. The timing generation unit 23 sends the generated timing signal to a corresponding one or more of the scan driver 24, the sustain driver 25 and the data driver 27. Furthermore, the timing generation unit 23 sends a timing signal to the timing generation unit 26 which generates and sends a timing signal for pulse application, to the data driver 27 in a sustain period.

The scan driver 24 is constituted by a driving circuit formed using a publicly-known driver IC. In response to a timing signal from the timing generation unit 23, the scan driver 24 generates and applies a set-up pulse and a scan pulse to the scan electrodes SCN1 to SCNk included in the panel unit 10.

The sustain driver 25 is constituted by a driving circuit formed using a publicly-known driver IC. In response to a timing signal from the timing generation unit 23, the sustain driver 25 generates and applies a set-up pulse and a sustain pulse to the sustain electrodes SUS1 to SUSk included in the panel unit 10.

The data driver 27 is constituted by a driving circuit formed using a publicly-known driver IC. In a write period, the data driver 27 selectively applies a write pulse to the data electrodes D1 to Dn, based on sub-field data from the preprocessor 21 and a timing signal sent from the timing generation unit 23. In a sustain period, each driving circuit built in the data driver 27 applies a pulse (hereinafter referred to as a sustain data pulse) to one or more corresponding data electrodes D, based on a timing signal sent from the timing generation unit 26. A method to control application of the sustain data pulse is described later.

1-3 Construction of the Data Driver 27

Figure 3:
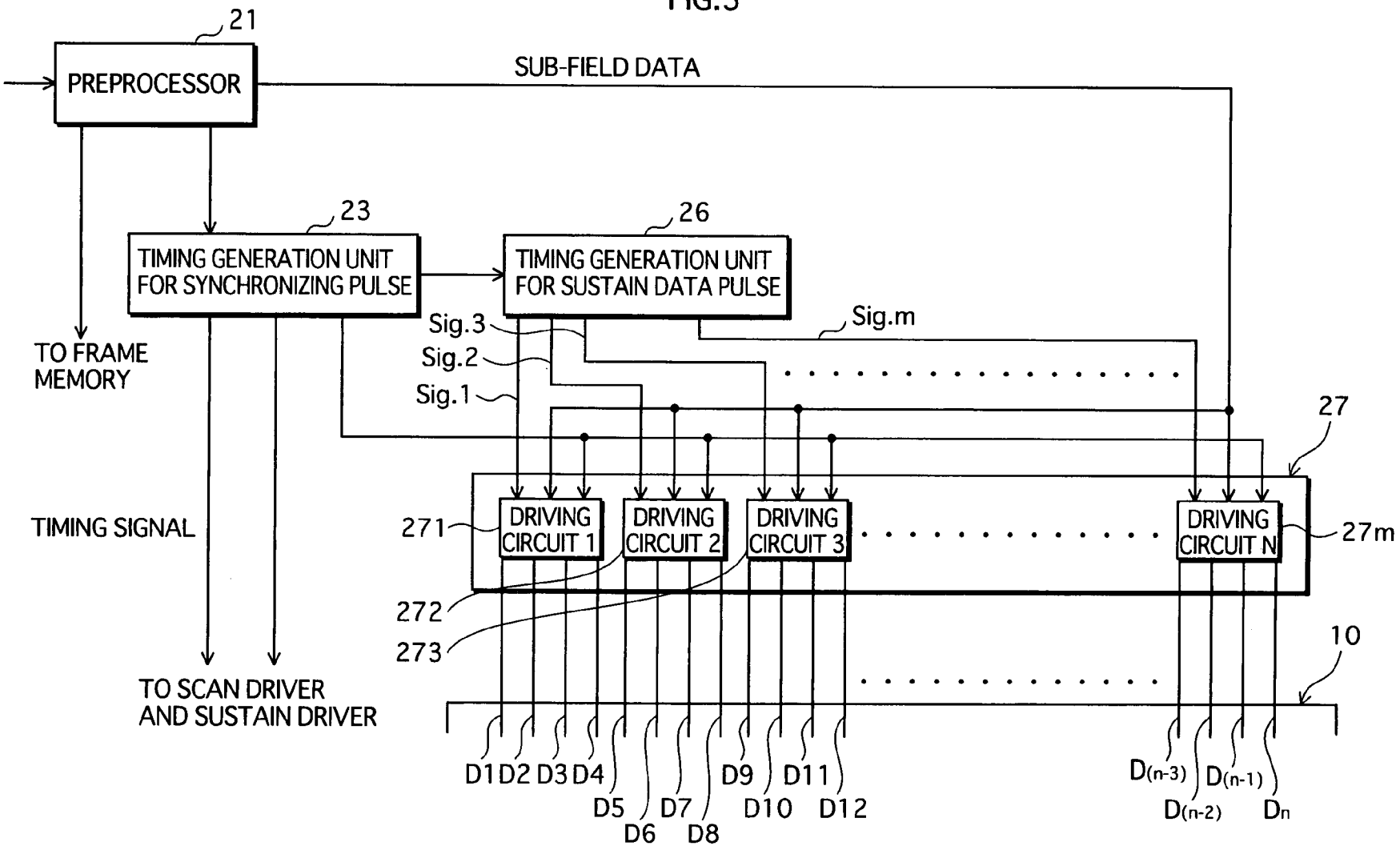
FIG. 3 is a block diagram illustrating, in detail, a circuit structure of a part of the PDP apparatus 1 which includes a data driver shown in FIG. 2.

The following describes the data driver 27 and constituents of the driving unit 20 relevant to the data driver 27 in detail, with reference to FIG. 3.

As shown in FIG. 3, the data driver 27 can receive a signal from the preprocessor 21, the timing generation unit 23, and the timing generation unit 26. Also, the data driver 27 is configured to be able to apply a write pulse and a sustain data pulse to the data electrodes D1 to Dn. Here, the data driver 27 has M driving circuits 271 to 27*m* built-in, and each of the driving circuits 271 to 27*m* is connected to a predetermined number of data electrodes D. In the first embodiment, as an example, each driving circuit is connected to four data electrodes D. In other words, the data electrodes D1 to Dn are divided into a plurality of groups of four data electrodes D. The driving circuits 271 to 27*m* are provided in a one-to-one correspondence with the groups of four data electrodes D.

The timing generation unit 26 inputs timing signals Sig. 1 to Sig. m to the driving circuits 271 to 27*m* respectively.

The preprocessor 21 and the timing generation unit 23 respectively input sub-field data and a timing signal to the data driver 27 in the same manner as their counterparts of a conventional PDP apparatus.

1-4 Driving Method for the PDP Apparatus 1

Figure 4:
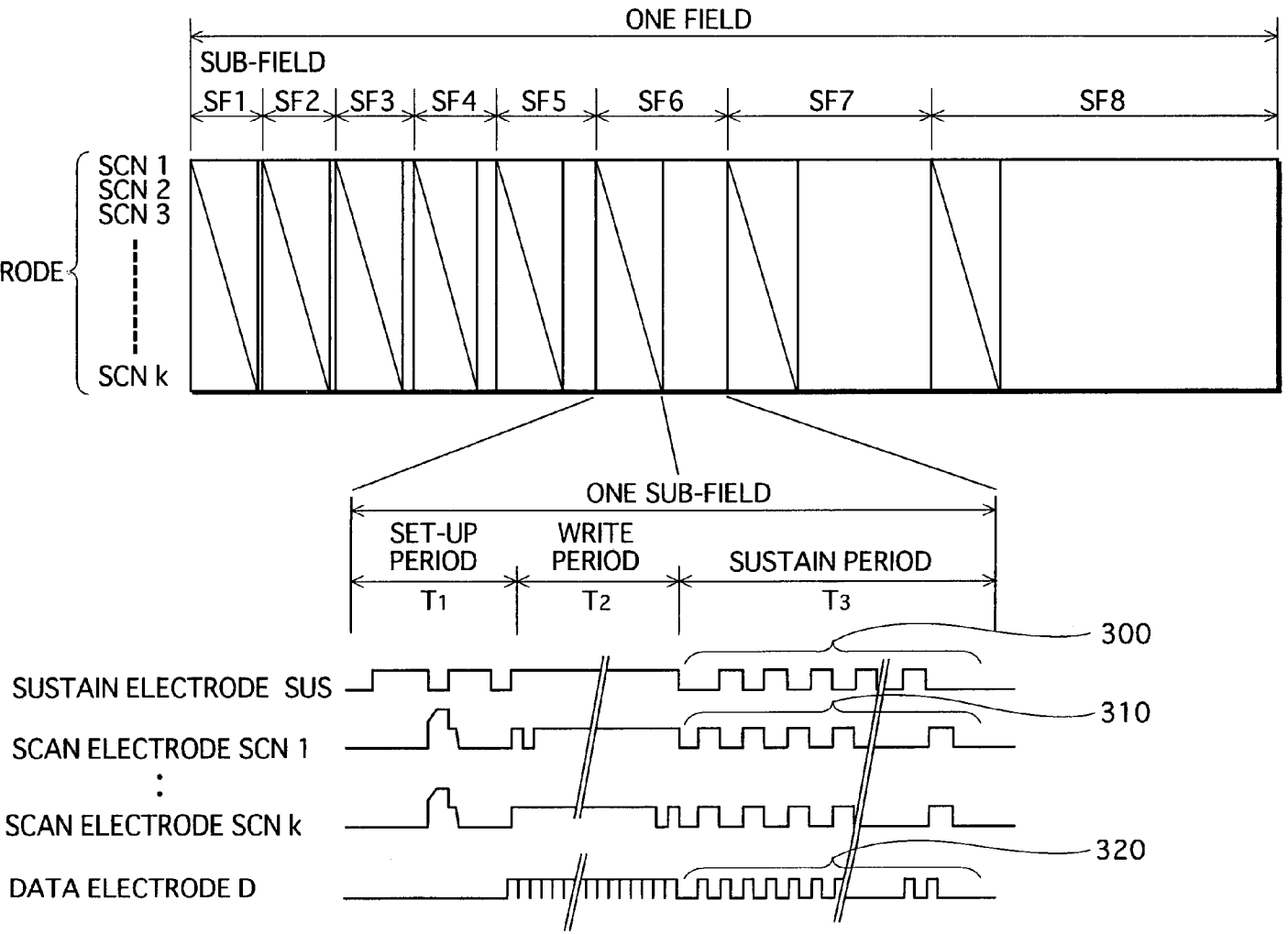
FIG. 4 illustrates a waveform of a voltage applied to each type of electrodes to drive the PDP apparatus 1.

The following describes a driving method for the PDP apparatus 1 with reference to FIG. 4. FIG. 4 illustrates a method to drive the PDP apparatus 1 using a field timesharing gradation display method. As an example, one field is divided into eight sub-fields SF1 to SF8 to express 256 gray levels. In FIG. 4, time is plotted along the horizontal axis, and each rectangular area crossed by a line indicates a write period.

As shown in FIG. 4, the PDP apparatus 1 relating to the first embodiment is driven in such a manner that one field is divided into eight sub-fields SF1 to SF8. The number of sustain pulses applied in each of the sub-fields SF1 to SF8 is set so that the relative luminance ratio of the eight sub-fields is 1:2:4:8:16:32:64:128. Here, lit/unlit states in the sub-fields SF1 to SF8 are controlled in accordance with data relating to display luminance. In this way, 256 gray levels can be expressed by various combinations of the sub-fields SF1 to SF8. According to the first embodiment, an image is displayed in 256 gray levels, but the present invention is not limited to such.

The sub-fields SF1 to SF8 are each constituted by a set-up period $T_1$, a write period $T_2$, and a sustain period $T_3$. The set-up period $T_1$ and the write period $T_2$ each have a predetermined duration, but the sustain period $T_3$ has a duration determined in accordance with a relative luminance ratio of a corresponding sub-field. The panel unit 10 is, for example, driven in the following manner to display an image. To start with, in the set-up period $T_1$, a set-up discharge is caused in all of the discharge cells in the panel unit 10. This eliminates an effect of a discharge generated in a previous sub-field, and absorbs unevenness in discharge properties.

In the write period $T_2$, the scan electrodes SCN1 to SCNk are scanned line by line in this order based on sub-field data. Thus, a weak discharge is generated between scan electrodes SCN and data electrodes D in discharge cells in which a sustain discharge needs to be performed in a current sub-field. As a result of the weak discharge, a wall charge accumulates in the discharge cells, on a surface of the protective layer 113 of the front panel 11.

In the sustain period $T_3$, sustain pulses 300 and 310 having a rectangular waveform are respectively applied to the sustain electrodes SUS and the scan electrodes SCN. The sustain pulses 300 and 310 each have a predetermined voltage and a predetermined cycle (for example, 2.5 μsec). The sustain pulse 300 applied to the sustain electrodes SUS and the sustain pulse 310 applied to the scan electrodes SCN have the same cycle, but are out of phase by half a cycle. The sustain pulses 300 and 310 are simultaneously applied to all of the discharge cells in the panel unit 10.

In addition, a pulse having a rectangular waveform (a sustain data pulse) 320 is applied to the data electrodes D in the sustain period $T_3$, according to the driving method for the PDP apparatus 1 relating to the first embodiment, as shown in FIG. 4.

1-5 Application of the Sustain Data Pulse 320

Figure 5:
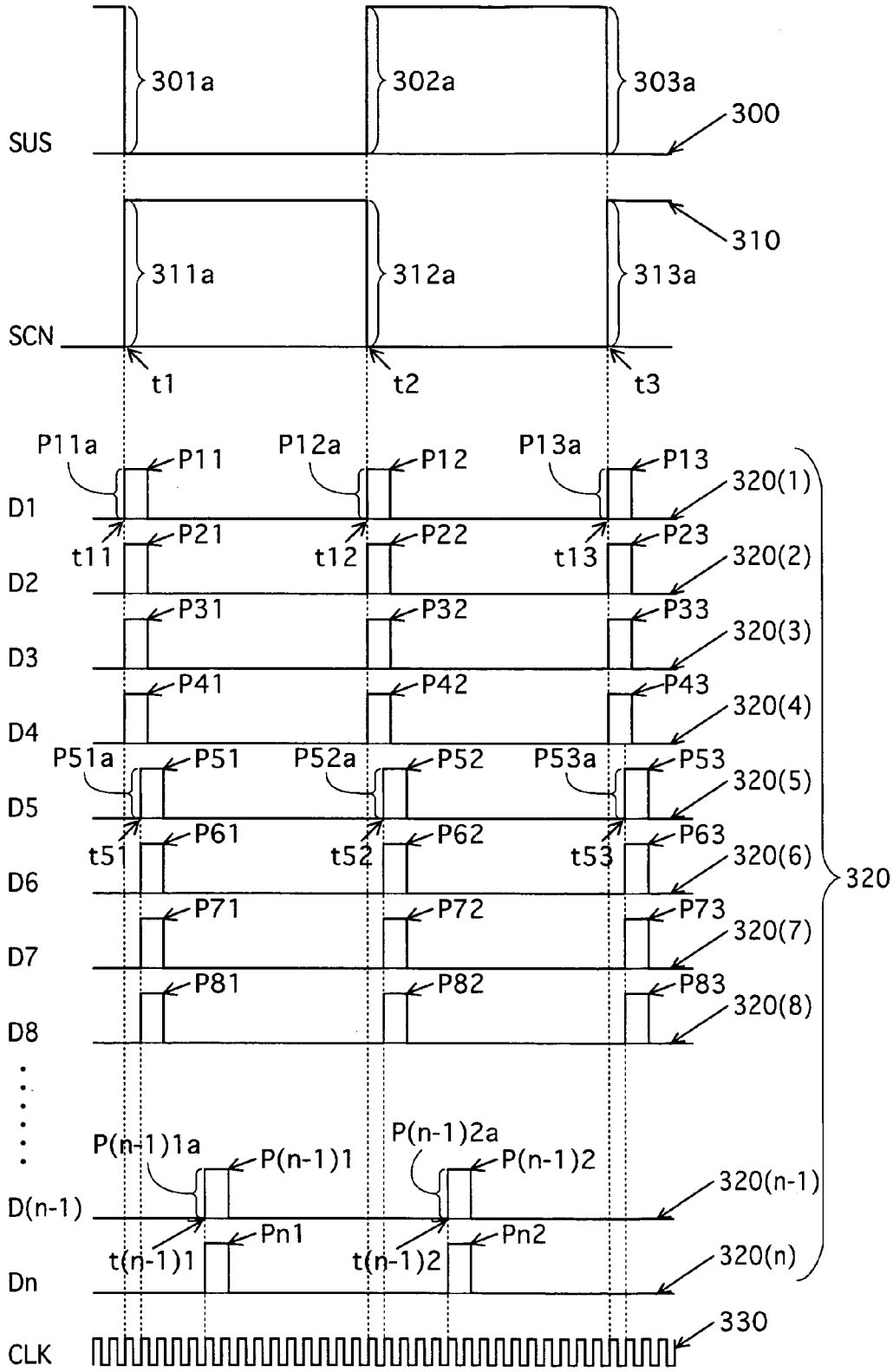
FIG. 5 illustrates a waveform of a voltage applied to each type of electrodes in a sustain period to drive the PDP apparatus 1.

The following describes a manner of applying the sustain data pulse 320 to the data electrodes D in the sustain period $T_3$, with reference to FIG. 5 which illustrates the sustain period $T_3$ shown in the driving chart of FIG. 4 in detail.

As seen from FIG. 5, the sustain pulses 300 and 310 are applied to the sustain electrodes SUS and the scan electrodes SCN in the sustain period $T_3$ so as to be out of phase by half a cycle as mentioned above. Furthermore, the sustain data pulses 320 are applied to the data electrodes D1 to Dn in the sustain period $T_3$ according to the first embodiment, as mentioned above. The first embodiment is characterized in that the sustain data pulses 320 differ in terms of timing of application among the data electrodes D.

To be specific, sustain data pulses 320(1) to 320(4) are respectively applied to data electrodes D1 to D4. Here, rectangular waveforms P11, P12 and P13 of the sustain data pulse 320(1) start to rise at timings t11, t12 and t13 (rise start timings) respectively. The same is true about rectangular waveforms P21 to P23 of the sustain data pulse 320(2), P31 to P33 of the sustain data pulse 320(3), and P41 to P43 of the sustain data pulse 320(4). On the other hand, the sustain pulse 300 applied to the sustain electrodes SUS starts to rise at a timing t2 (a rising portion of 302*a*), and the sustain pulse 310 applied to the scan electrodes SCN starts to rise at timings t1 and t3 (rising portions of 311*a* and 313*a*). Here, the rise start timings t11, t12 and t13 are substantially the same as the rise start timings t1, t2 and t3. In other words, when receiving a timing signal Sig. 1 from the timing generation unit 26, a driving circuit 1 (271) to which the data electrodes D1 to D4 are connected applies the sustain data pulses 320(1) to 320(4) to the data electrodes D1 to D4.

Rectangular pulses P51 to P53, P61 to P63, P71 to P73, and P81 to P83 which are applied to data electrodes D5, D6, D7 and D8 start to rise at timings t51, t52 and t53. Here, there is a slight time lag from the rise start timings t1, t2 and t3 of the sustain pulses 300 and 310 to the rise start timings t51, t52 and t53. The time lag is set in accordance with a clock pulse 330 shown in the bottom of FIG. 5.

As shown in FIG. 5, when driving the PDP apparatus 1, the sustain data pulses 320(1) to 320(*n*) are applied to the data electrodes D1 to Dn in the sustain period $T_3$, in such a manner that each of the driving circuits 271 to 27*m* raises rectangular pulses at a different timing.

As seen from FIG. 5, a potential of each rectangular pulse of the sustain data pulses 320(1) to 320(*n*) applied to the data electrodes D1 to Dn in the sustain period $T_3$ is uniform. Here, strictly speaking, the sustain pulses 300 and 310 and the sustain data pulse 320 do not have a completely rectangular waveform shown in FIG. 5. Which is to say, the rising portion 311*a* of the sustain pulse 310 applied to the scan electrodes SCN has a gradient. In other words, there is a time lag (for example, 250 nsec) between the rise start timing t1 and a timing at which a predetermined potential is achieved. Taking this into account, the sustain data pulses 320(1) to 320(*n*) are applied at timings that are determined with respect to timings at which the voltage of the sustain pulses 300 and 310 reaches a predetermined level after a certain time period (for example, 250 nsec.) has elapsed from the rise start timings t1, t2, . . . .

1-6 Advantages of the PDP Apparatus 1

Figure 6:
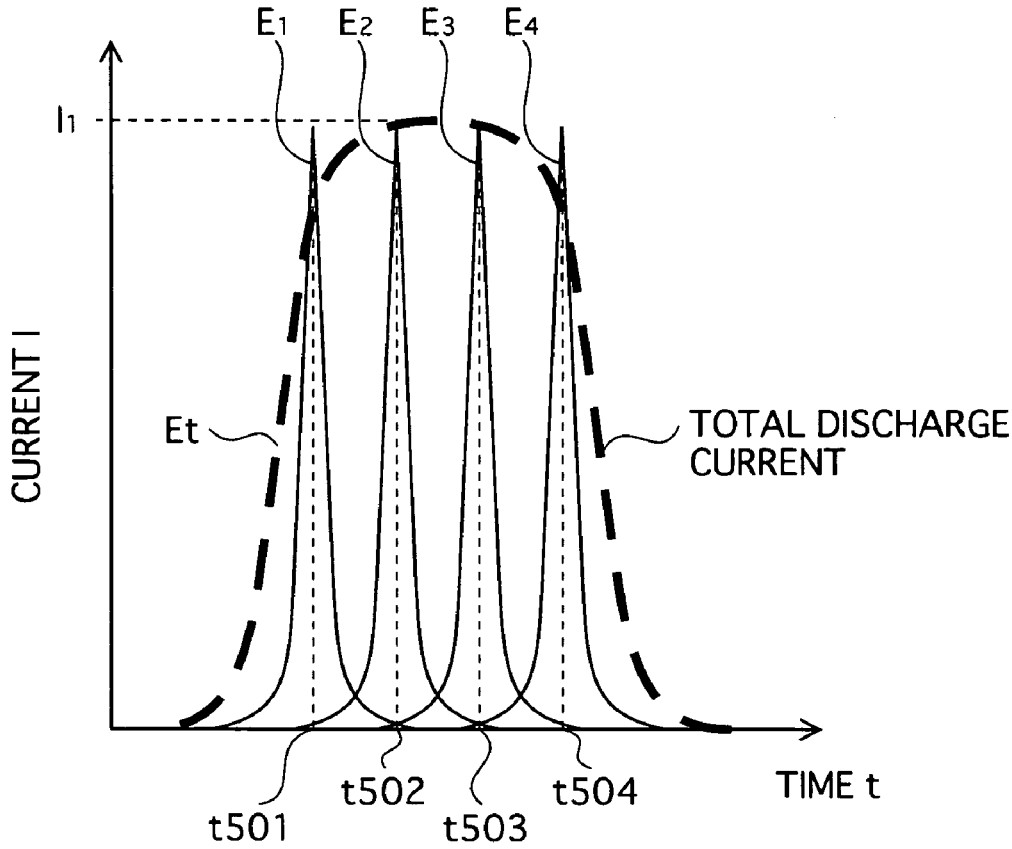
FIG. 6 is a schematic diagram illustrating discharge currents flowing into a scan electrode and a sustain electrode when driving the PDP apparatus 1.

The following describes advantages of the PDP apparatus 1 relating to the first embodiment, with reference to FIG. 6. FIG. 6 is a schematic view illustrating discharge currents flowing in the scan electrodes SCN and the sustain electrodes SUS in the sustain period $T_3$.

Figure 12:
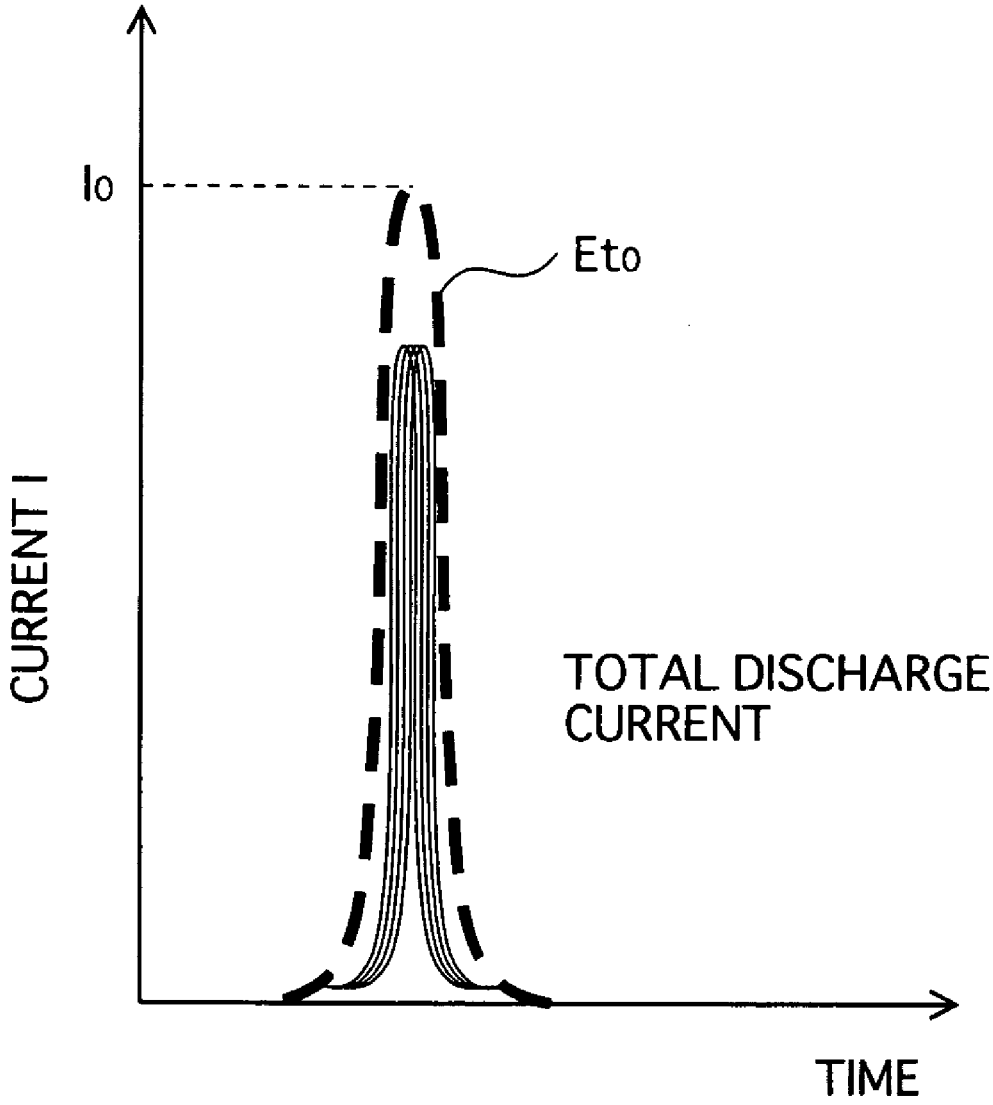
FIG. 12 is a schematic diagram illustrating discharge currents flowing into a scan electrode and a sustain electrode in the conventional PDP apparatus.

As shown in FIG. 6, discharge currents $E_1$, $E_2$, $E_3$ and $E_4$ flowing in the scan electrodes SCN and the sustain electrodes SUS in the sustain period $T_3$ respectively peak at times $t_{501}$, $t_{502}$, $t_{503}$ and $t_{504}$, which are different from each other. According to the first embodiment, each of the driving circuits 271 to 27*m* applies a set of sustain data pulses 320 at a different timing in the sustain period $T_3$, as presented in FIG. 5. This can make a difference in time period from the application of the sustain pulses 300 and 310 to occurrence of a sustain discharge. Hence, the discharge currents $E_1$, $E_2$, $E_3$ and $E_4$ each peak at a different time in the PDP apparatus 1 as shown in FIG. 6. As a consequence, a total discharge current Et flowing in the sustain period $T_3$ observed when driving the PDP apparatus 1 can be reduced, when compared with a total discharge current $Et_0$ (shown in FIG. 12) observed when driving a conventional PDP apparatus.

As explained above, each of the driving circuits 271 to 27*m* applies a set of sustain data pulses 320 at a different timing in the sustain period $T_3$ when driving the PDP apparatus 1. This means that a sustain discharge starts at three or more different timings in the sustain period $T_3$. Therefore, the first embodiment of the present invention is superior to the technique disclosed in Japanese patent application publication No. H11-149274, from the aspect of enhancement of display quality.

Moreover, discharge currents generated in the sustain period $T_3$ differ in terms of peak time without increasing the number of power sources in the PDP apparatus 1. Therefore, the first embodiment of the present invention is superior to the technique disclosed in the Japanese patent application publication No. H10-133622, from the aspect of a manufacturing cost.

In the PDP apparatus 1, since a voltage drop caused by the discharge currents in the sustain period $T_3$ can be reduced, high display quality is maintained. Here, a current drive power required for the driving unit 20 is determined by a peak value of a total discharge current. In the PDP apparatus 1, since the sustain data pulses 320 differ in terms of timing of application, a peak value of the total discharge current Et can be made lower than in the related art. This means that the driving unit 20 is required to have only a relatively small current drive power. Therefore, an inexpensive driving circuit can be used for the PDP apparatus 1 relating to the first embodiment. This reduces the manufacturing cost of the PDP apparatus 1.

If possible in terms of manufacturing cost, two or more power sources which each have a different voltage value may be used. Thus, the sustain data pulses 320 differ with respect to not only timing of application, but also potential. This can differentiate the discharge currents more minutely in terms of peak time in the sustain period $T_3$, and therefore achieves a better result in lowering the peak value of the total discharge current Et. However, it should be taken into consideration that an excessively large difference in potential causes enormous unevenness in luminance among the discharge cells. In this case, display quality is adversely degraded.

According to the above description, each driving circuit in the data driver 27 applies a pulse to four data electrodes D in the first embodiment. However, the present invention is not limited to such. The most distinctive feature of the first embodiment is that each driving circuit in the data driver 27 applies a set of sustain data pulses 320 at a different timing. Thus, a sustain discharge differs with respect to timing of generation. This produces an effect of lowering a peak value of a total discharge current in the scan electrodes SCN and the sustain electrodes SUS.

1-7 Confirmation Data

Figure 7:
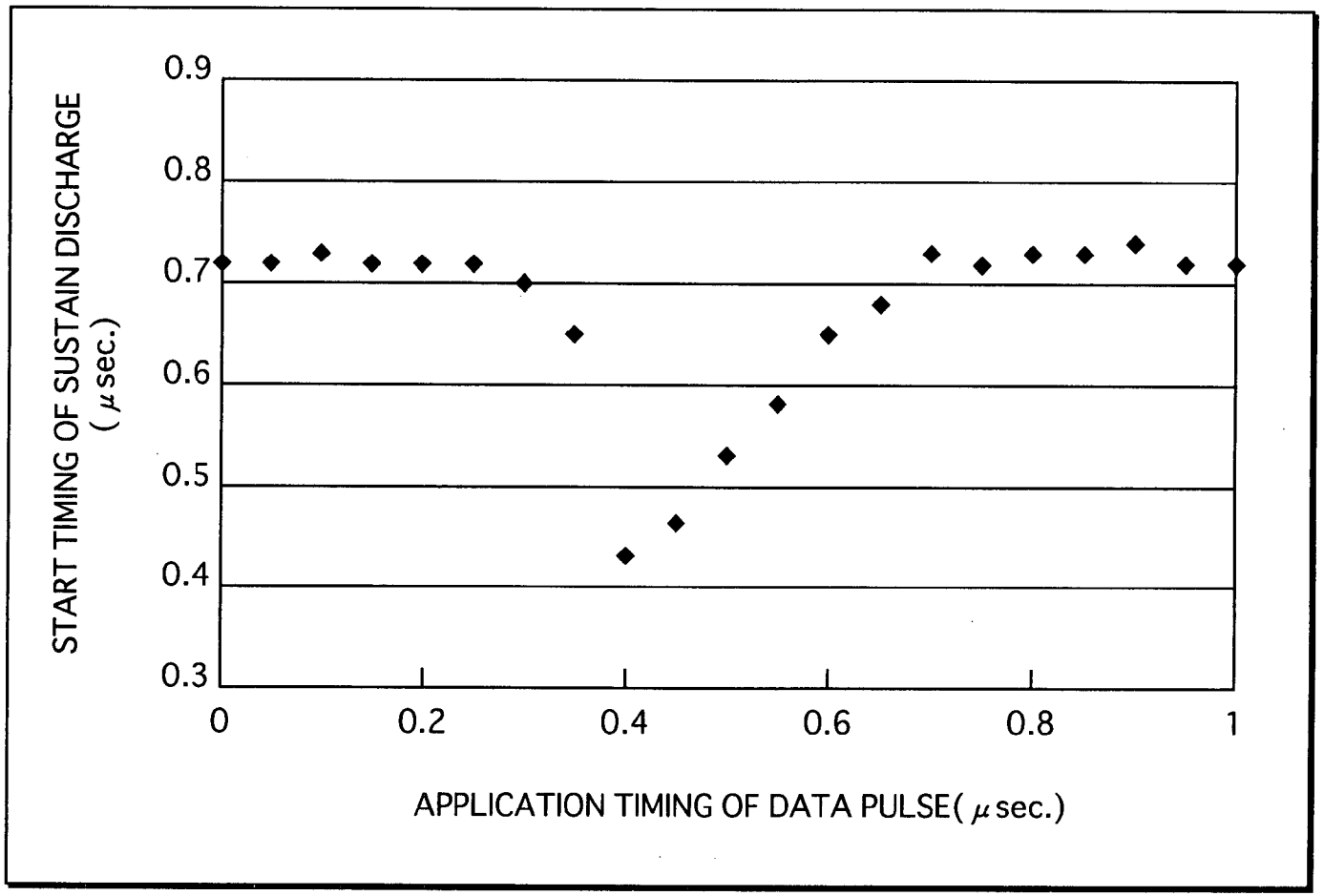
FIG. 7 illustrates how a time period from application of a sustain pulse to application of a sustain data pulse is related to a time period from application of a sustain pulse to generation of a sustain discharge.

The following describes how a time difference from application of the sustain pulse 300 or 310 to application of the sustain data pulse 320 (an application timing) is related to a time difference from application of the sustain pulses 300 and 310 to occurrence of a sustain discharge (a discharge start timing), with reference to FIG. 7. FIG. 7 is a characteristic diagram illustrating the relation between the application timing and the discharge start timing, when the sustain pulses 300 and 310 rising in 0.5 μsec are applied to the sustain electrodes SUS and the scan electrodes SCN.

As shown in FIG. 7, when the application timing is within a range from 0 μsec to 0.3 μsec, the discharge start timing is constant at approximately 0.73 μsec. Similarly, when the application timing is 0.7 μsec or more, the discharge start timing is constant at approximately 0.73 μsec. This is because the sustain data pulses 320 are applied to the data electrodes D before the voltage of the sustain pulses 300 and 310 applied to the sustain electrodes SUS and the scan electrodes SCN rises to a predetermined level. Specifically speaking, the sustain data pulses 320 are applied too early, and therefore make no difference in discharge start timing.

The predetermined level of the voltage is equal to approximately 60% of a voltage value $V_{SUS}$ which is achieved at the end of the rising portions of the sustain pulses 300 and 310. This percentage is calculated as follows. FIG. 7 shows that, when the application timing is 0.3 μsec or more, the discharge start timing varies. Based on this, 0.3/0.5=0.6. Thus, the predetermined level of the voltage can be calculated based on this percentage. However, it should be noted that the predetermined level is determined in accordance with a gradient of increase in voltage in the rising portions, if the sustain pulses 300 and 310 do not rise linearly.

When the application timing is 0.7 μsec or more, application of the sustain data pulses 320 makes no difference in discharge start timing of a sustain discharge. This is because the sustain data pulses 320 are applied after a time at which a sustain discharge is generated by the sustain pulses 300 and 310 when the sustain data pulses 320 are assumed not to be applied.

As seen from FIG. 7, when the application timing is in a range from 0.3 μsec to 0.7 μsec, the discharge start timing takes the smallest value of 0.43 μsec at the application timing of 0.4 μsec. Furthermore, when the application timing is changed within a range from 0.4 μsec to 0.7 μsec, the discharge start timing varies substantially linearly.

1-8 Modifications of the First Embodiment

According to the first embodiment, each of the driving circuits 271 to 27*m* in the data driver 27 applies a voltage to four data electrodes D. However, the present invention is not limited to such.

Furthermore, the cycle of the sustain data pulses 320 applied to the data electrodes D is equal to a half cycle of the sustain pulses 300 and 310, as shown in FIG. 5. However, the present invention is not limited to such. As an alternative example, the cycle of the sustain data pulses 320 may be equal to the cycle of the sustain pulses 300 and 310. Which is to say, while the sustain data pulse 320 is applied to each of the data electrodes D1 to Dn once, a sustain discharge may be generated twice. Moreover, the cycle of the sustain data pulses 320 may be equal to an integral multiple of the cycle of the sustain pulses 300 and 310. In other words, while the sustain data pulse 320 is applied to each of the data electrodes D1 to Dn once, a sustain discharge may be generated four or more times. According to these modifications, the sustain data pulses 320 can also produce an effect of reducing a voltage drop, differently from a conventional driving method where the sustain data pulses 320 are not applied.

As shown in FIG. 5 and the like, the sustain pulses 300 and 310 and the sustain data pulses 320 have a rectangular waveform. However, the pulses 300, 310 and 320 may have a waveform with gradient rising and falling portions. If such is the case, the time at which the sustain data pulses 320 are applied to the data electrodes D is varied between the time at which the voltage of the sustain pulses 300 and 310 rises to the predetermined level and the time at which a sustain discharge is generated by the sustain pulses 300 and 310 when the sustain data pulses 320 are assumed not to be applied, as stated in the section 1-7.

Furthermore, each of the sustain data pulses 320(1) to 320(*n*) preferably has the same pulse width. However, the present invention is not limited to such. Similarly, each of the sustain data pulses 320(1) to 320(*n*) preferably has the same voltage in order to reduce unevenness in luminance among the discharge cells. However, the sustain data pulses 320 may differ in terms of voltage at several levels. In this case, unevenness in luminance is observed. In addition, since the number of power sources needs to be increased, the problem of a higher manufacturing cost emerges.

Second Embodiment

Figure 8:
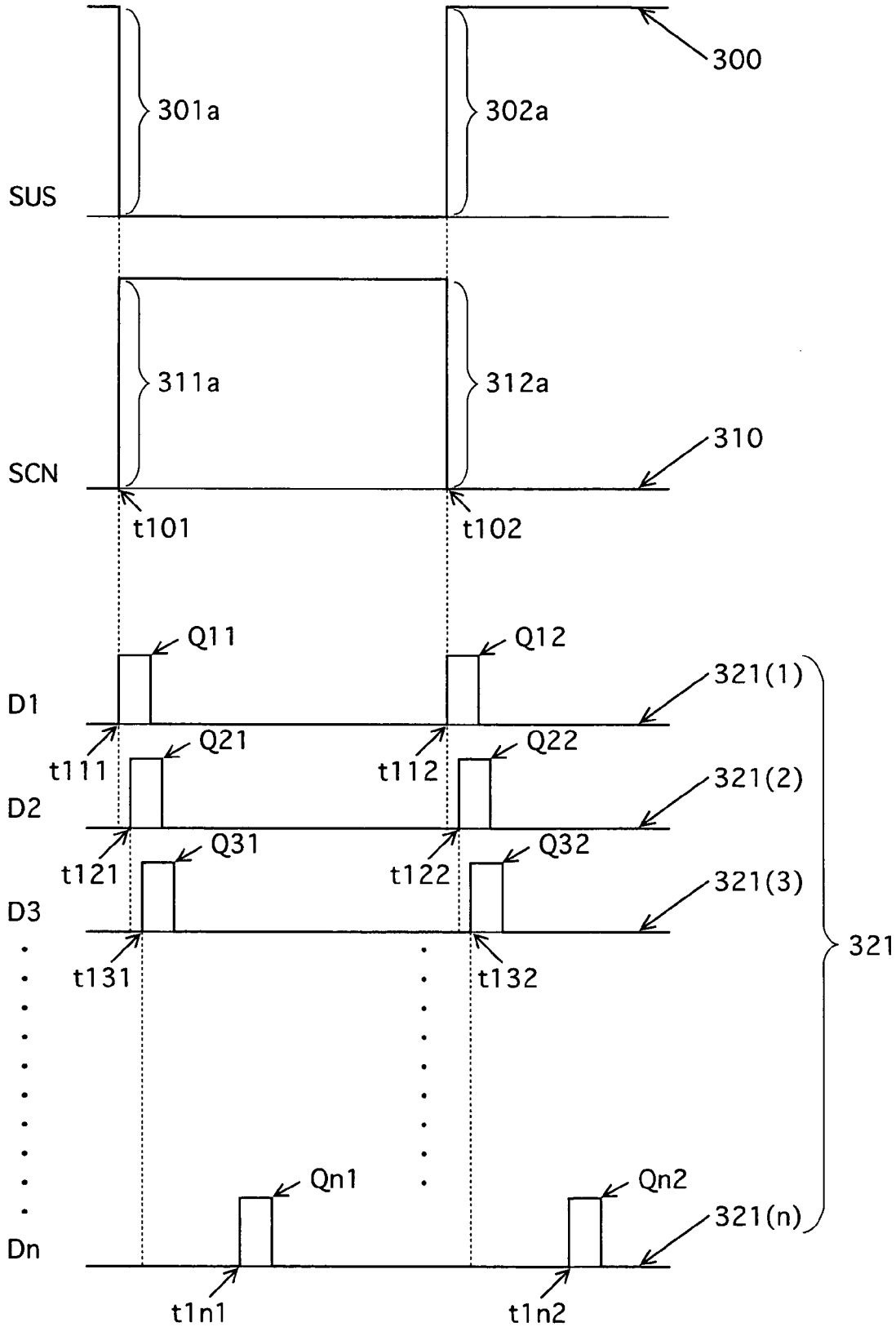
FIG. 8 illustrates a waveform of a voltage applied to each type of electrodes in a sustain period to drive a PDP apparatus 2 relating to a second embodiment.

The following describes a PDP apparatus 2 relating to a second embodiment and a driving method for the same, with reference to FIG. 8.

The PDP apparatus 2 has substantially the same construction as the PDP apparatus 1 shown in FIG. 2. Therefore, the PDP apparatus 2 is not illustrated in the drawings. The PDP apparatus 2 is different form the PDP apparatus 1 in that the timing generation unit 26 (shown in FIG. 2) is configured to be able to specify a timing of applying a sustain data pulse 321 to each one of the data electrodes D1 to Dn in the sustain period. This configuration of the timing generation unit 26 can be realized making use of the construction of the timing generation unit 23 which sends a timing signal for applying a pulse to each of the data electrode D1 to Dn in the write period $T_2$.

According to the driving method for the PDP apparatus 2, the sustain data pulses 321(1) to 321(*n*) are respectively applied to the data electrodes D1 to Dn in the sustain period $T_3$, in such a manner that each of the sustain data pulses 321(1) to 321(*n*) is applied at a different timing, as presented in FIG. 8. To be more specific, a rectangular pulse Q11 is applied to the data electrode D1 at substantially the same timing (t111) as the sustain pulses 300 and 310 (t101). A rectangular pulse Q21 is applied to the data electrode D2 at a timing t121 which is slightly later than the rise start timings t101 and t111. In this way, each of the sustain data pulses 321(1) to 321(*n*) is applied at a different timing.

As well as in the first embodiment, rectangular pulses (Q11, Q12, . . . ) of the sustain data pulses 321 are set to start rising after the time at which the voltage of the sustain pulses 300 and 310 reaches a predetermined level in the rising portions 302*a* and 311*a*, in the second embodiment.

As described above, each of the sustain data pulses 321(1) to 321(*n*) is applied at a different timing in the sustain period $T_3$ when driving the PDP apparatus 2. In this way, a time period from the application of the sustain pulses 300 and 310 to generation of a sustain discharge differs, in accordance with a time lag from the application of the sustain pulses 300 and 310 to the application of the sustain data pulses 321(1) to 321(*n*), as in the first embodiment. This differentiates discharge currents in terms of peak time in the PDP apparatus 2, as shown in FIG. 6. Consequently, the total discharge current Et in the sustain period $T_3$ can be reduced, when compared with the total discharge current $Et_0$ (see FIG. 12) in the conventional PDP apparatus. Furthermore, the sustain data pulse 321 is controlled for (applied at a different timing to) each of the data electrodes D1 to Dn according to the second embodiment. This can achieve a more favorable result regarding the differentiation of discharge currents than in the PDP apparatus 1 relating to the first embodiment.

For the reasons stated above, the second embodiment can reduce a voltage drop caused by the discharge currents in the sustain period $T_3$, thereby maintaining high display quality. Furthermore, since the sustain data pulses 321 differ in terms of timing of application according to the second embodiment, the peak value of the total discharge current Et can be lowered. Therefore, an inexpensive driving circuit with a relatively small current drive power can be used to constitute the PDP apparatus 2. Accordingly, the PDP apparatus 2 is superior to the conventional PDP apparatus from the aspect of manufacturing cost.

As well as the first embodiment, the second embodiment can be modified in various manners. Such modifications of the second embodiment can also produce the above-described effects.

Third Embodiment

Figure 9:
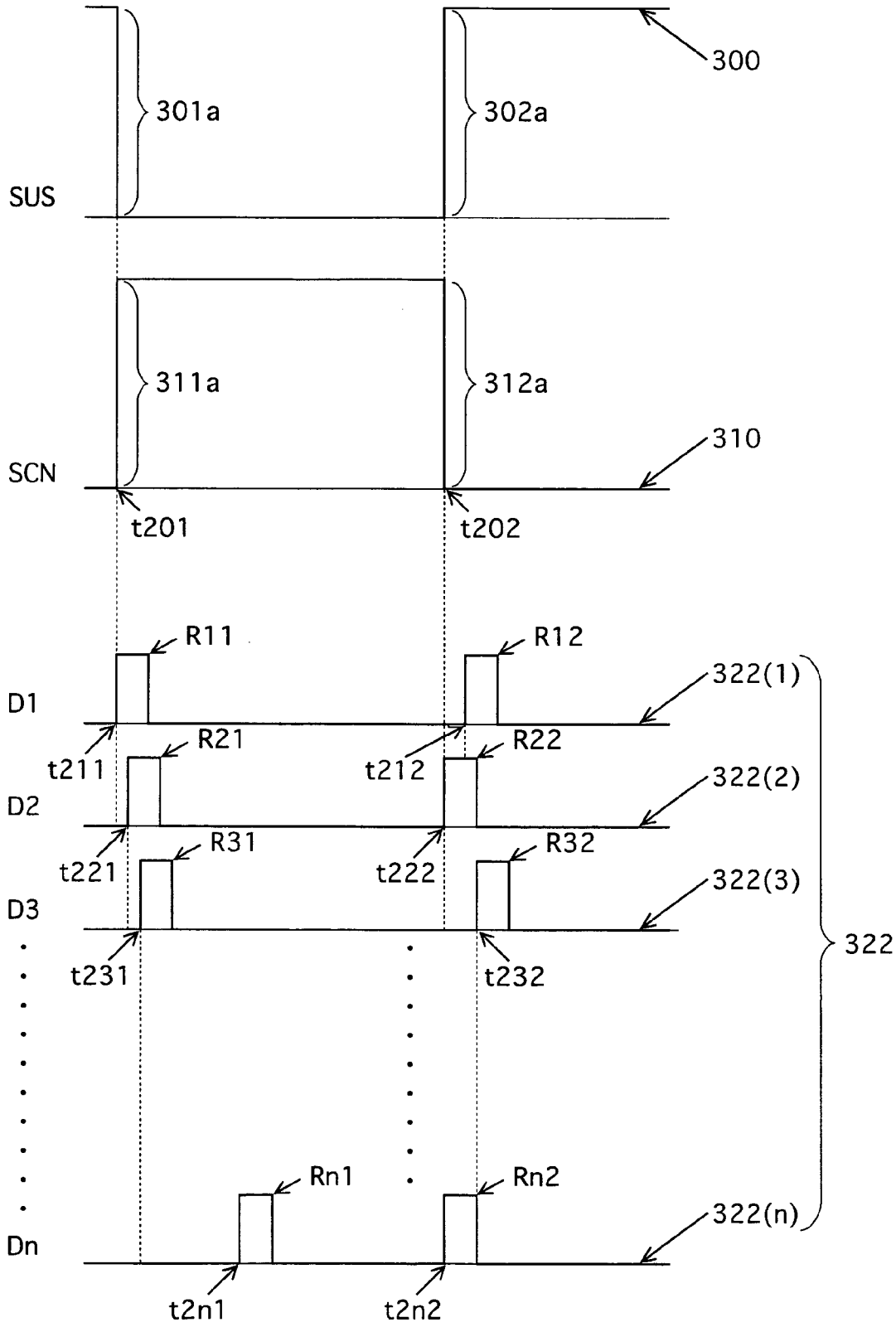
FIG. 9 illustrates a waveform of a voltage applied to each type of electrodes in a sustain period to drive a PDP apparatus 3 relating to a third embodiment.

The following describes a PDP apparatus 3 relating to a third embodiment and a driving method for the same, with reference to FIG. 9.

The PDP apparatus 3 is not illustrated in the drawings. As well as the PDP apparatus 2, the timing generation unit 26 is configured to be able to specify a timing of applying a sustain data pulse 322 to each of the data electrodes D1 to Dn in the sustain period $T_3$ in the PDP apparatus 3. The third embodiment is different from the second embodiment in terms of the following feature of the driving method.

As shown in FIG. 9, sustain data pulses 322(1) to 322(*n*) are respectively applied to the data electrodes D1 to Dn in the sustain period $T_3$, when driving the PDP apparatus 3. Here, rectangular pulses R11, R21, . . . , Rn1 of the sustain data pulses 322(1) to 322(*n*) are respectively applied in the third embodiment, at the same timings as in the second embodiment (shown in FIG. 8), which are determined with respect to a timing t201 at which the sustain pulse 300 falls (301*a*) and the sustain pulse 310 rises (311*a*).

Furthermore, rectangular pulses R12, R22, . . . , Rn2 are respectively applied at timings t212, t222, t232, . . . , t2*n*2, which are determined with respect to a timing t202 at which the sustain pulse 300 rises (302*a*) and the sustain pulse 310 falls (312*a*).

Here, the timings of applying the rectangular pulses are set so as to satisfy the following condition. For each of the data electrodes D1 to Dn, an average time period from the time (t201, . . . ) at which the sustain pulse 300 or 310 is applied to the time (t211, . . . ) at which the rectangular pulse (R11, . . . ) is applied is substantially the same, for each sub-field or field. In short, the timings at which the sustain data pulses 322 are applied are determined based on the following formulas in the third embodiment.

$$t1_{ave}=Ave((t211-t201),(t212-t202),\ldots) \quad \text{(FORMULA 1)}$$

$$t2_{ave}=Ave((t221-t201),(t222-t202),\ldots) \quad \text{(FORMULA 2)}$$

$$t3_{Ave}=Ave((t231-t201),(t232-t202),\ldots) \quad \text{(FORMULA 3)}$$

This calculation is conducted for each of the data electrodes D1 to Dn. It should be noted that such an average time period is obtained for each sub-field or field as mentioned above.

The sustain data pulses 322(1) to 322(*n*) are applied at timings which are determined so as to satisfy the following formula (4) that defines the relation between the average time periods calculated for the data electrodes D1 to Dn.

$$t1_{Ave}=t2_{Ave}=t3_{Ave}=\ldots=tn_{Ave} \quad \text{(Formula 4)}$$

The third embodiment described above can differentiate the discharge currents in terms of peak time in the sustain period $T_3$, as well as the first and second embodiments. Therefore, the third embodiment can reduce a voltage drop caused by the discharge currents in the sustain period $T_3$, thereby maintaining high display quality. Furthermore, since the sustain data pulses 322 differ in terms of timing of application, the peak value of the total discharge current Et can be lowered. This makes it possible to use an inexpensive driving circuit with a relatively small current drive power for the PDP apparatus 3. Hence, the PDP apparatus 3 is superior to the conventional PDP apparatus from the aspect of manufacturing cost.

According to the third embodiment, in each of the sustain data pulses 322(1) to 322(*n*), a time difference between the application of each rectangular pulse and the application of a corresponding one of the sustain pulses 300 and 310 is not constant. This construction can reduce occurrence of unevenness in luminance among groups of discharge cells formed by the respective data electrodes D. According to the second embodiment, on the other hand, a time difference from the application of each rectangular pulse of the sustain data pulse 322(1) to the data electrode D1 to the application of the sustain pulse 300 or 301, for example, is constant as shown in FIG. 8. To be specific, time differences (t111–t101), (t112–t102), . . . are of the same value in each sub-field or field. The same rule applies to the rest of the sustain data pulses 322. This causes unevenness in luminance among the groups of discharge cells formed by the respective data electrodes D.

According to the PDP apparatus 3 relating to the third embodiment, such unevenness in luminance is less likely to be caused. This is because the average time difference is the same for each data electrode D, in each sub-field or field.

To sum up, the PDP apparatus 3 relating to the third embodiment can achieve less unevenness in luminance, in addition to the effects of the PDP apparatuses 1 and 2. Therefore, the PDP apparatus 3 attains high display quality.

The third embodiment can be modified in various manners, as well as the first and second embodiments. Such modifications can also produce the above-described effects.

Fourth Embodiment

Figure 10:
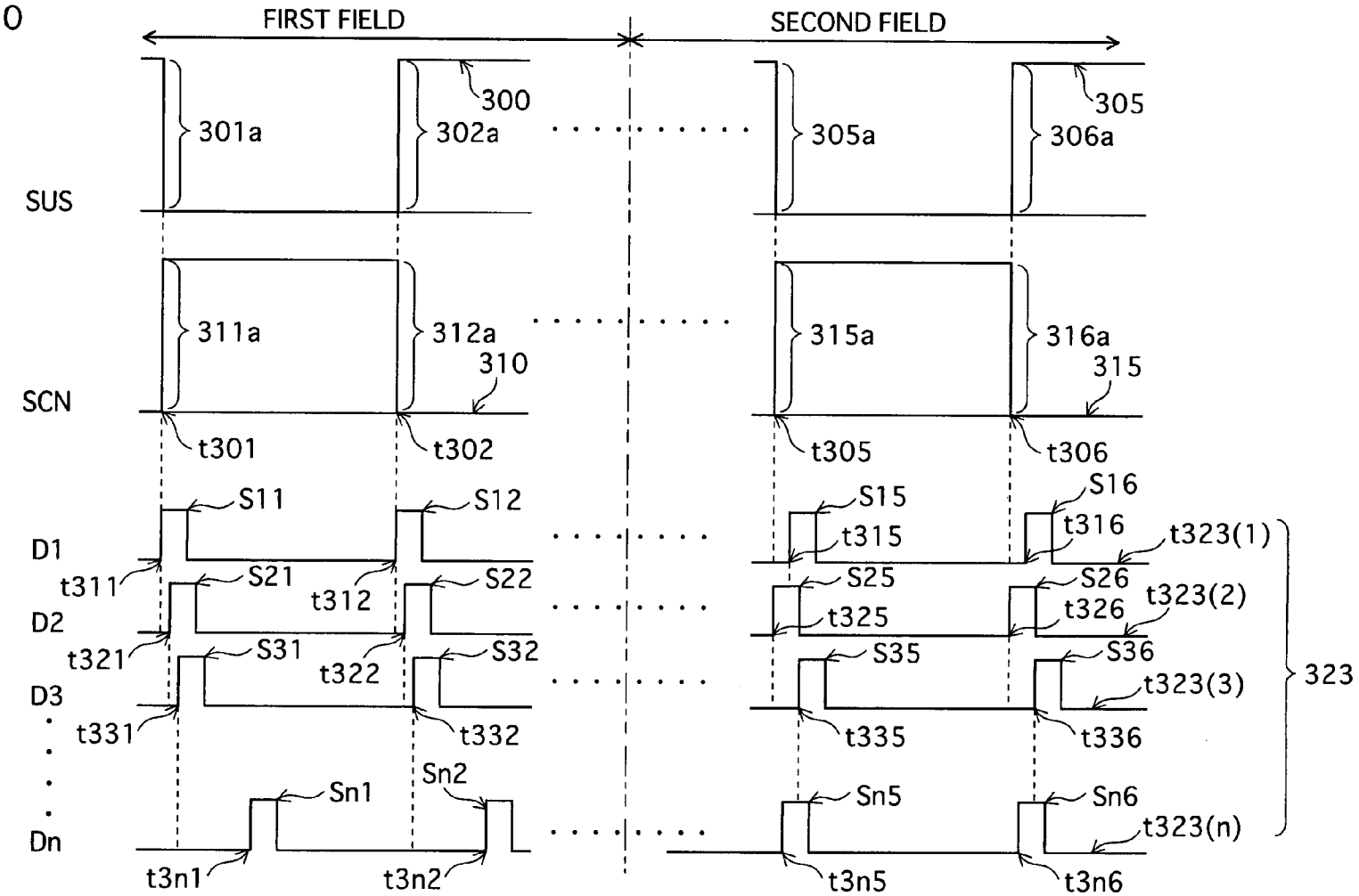
FIG. 10 illustrates a waveform of a voltage applied to each type of electrodes in a sustain period to drive a PDP apparatus 4 relating to a fourth embodiment.
Figure 11:
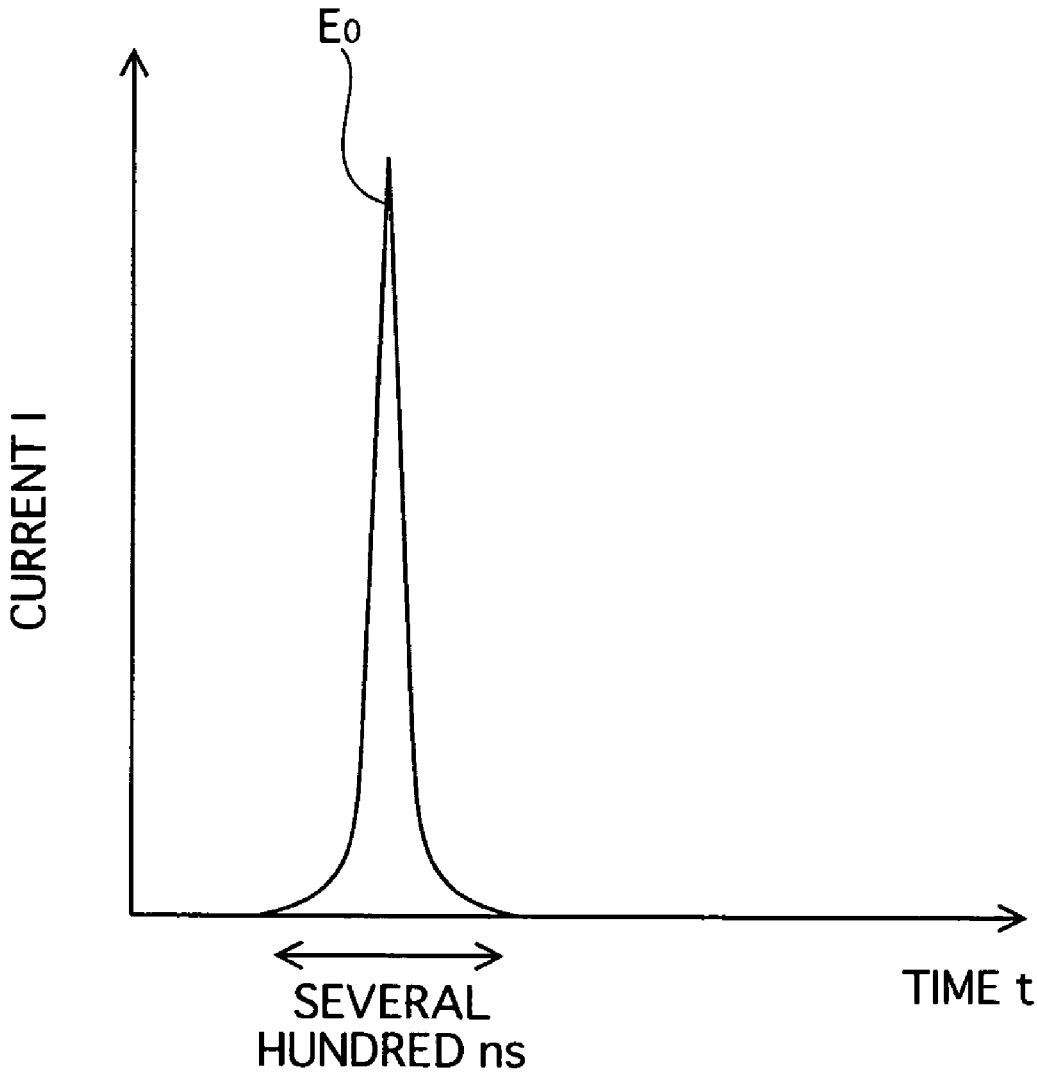
FIG. 11 is a schematic diagram illustrating a discharge current flowing into one discharge cell when driving a conventional PDP apparatus.

The following describes a driving method for a PDP apparatus 4 relating to a fourth embodiment, with reference to FIG. 10. In FIG. 10, a sustain period $T_{31}$ of a sub-field in a first field is shown on the left side, and a sustain period $T_{32}$ in a sub-field in a second field following the first field is shown on the right side.

As seen from FIG. 10, in the first field, rectangular pulses S11, S12, . . . are applied to the data electrodes D1 to Dn at timings t311, t312, . . . . Here, the rise start timings t311, t312, . . . are set in the same manner as in the second embodiment. In more detail, a group of rectangular pulses (S11, S12, . . . ) applied to each of the data electrodes D1 to Dn in the sustain period $T_{31}$ is slightly different in terms of timing of application.

The application of the rectangular pulses S11, S12, . . . comes after the timings t301, t302, . . . at which the sustain pulses 310 and 300 are applied, or, to be more specific, after the voltage of the sustain pulses 300 and 310 rises to a predetermined level in the rising portions 302*a* and 311*a*, as in the first to third embodiments.

In the second field, on the other hand, rectangular pulses S15, S16, . . . are applied to the data electrodes D1 to Dn at timings t315, t316, . . . . Here, the timings t315, t316, . . . are determined in the same manner as in the third embodiment as follows. A time difference is calculated from the timings t305, t306, . . . at which the sustain pulses 310 and 300 are applied to the timings t315, t316, . . . at which the rectangular pulses S15, S16, . . . are applied to the data electrodes D1 to Dn in the sustain period $T_{32}$. Furthermore, an average value of such time differences for each of the data electrodes D1 to Dn is calculated, for each sub-field or field. Here, the average value is substantially the same for each of the data electrodes D1 to Dn. This configuration is not further described here as it is described in the third embodiment.

According to the driving method relating to the fourth embodiment, discharge currents differ with respect to peak time in the sustain periods $T_{31}$ and $T_{32}$, as in the first to third embodiments. Thus, the fourth embodiment can reduce a voltage drop caused by the discharge currents in the sustain periods $T_{31}$ and $T_{32}$, thereby maintaining high display quality. In addition, since sustain data pulses 323 differ in terms of timing of application in a different manner for each field as shown in FIG. 10, the peak value of the total discharge current Et can be lowered. This makes it possible to use an inexpensive driving circuit with a relatively small current drive power for the PDP apparatus 4 relating to the fourth embodiment. Therefore, the PDP apparatus 4 is superior to the conventional PDP apparatus with respect to manufacturing cost.

The fourth embodiment can be modified in various manners, as well as the first and second embodiments. Such modifications can also produce the above-described effects.

Other Modifications for the First to Fourth Embodiments

According to the first to fourth embodiments, every sub-field in a field has the set-up period $T_1$, the write period $T_2$, and the sustain period $T_3$, as shown in FIG. 4. However, the present invention is not limited to such. As an alternative example, a field may have a sub-field which has only the write period $T_2$ and the sustain period $T_3$, or a sub-field made up only by the sustain period $T_3$.

Furthermore, as briefly mentioned in the first to fourth embodiments, the sustain data pulses 320, 321, 322, or 323 applied to each of the data electrodes D1 to Dn in the sustain period $T_3$ may have a different voltage, if possible in terms of manufacturing cost. In this case, it should be noted that a difference in voltage needs to be set within a range that does not cause large unevenness in luminance.

INDUSTRIAL APPLICABILITY

The present invention can be utilized to realize a display apparatus for use in computers and televisions, especially a display apparatus with high display quality.

The invention claimed is:

1. A PDP apparatus comprising a panel unit and a driving unit, the panel unit including a first substrate on which a plurality of pairs of first and second electrodes are formed and a second substrate on which a plurality of third electrodes are formed, the first substrate and the second substrate being opposed to each other with a discharge space therebetween so as to form discharge cells at areas where the plurality of pairs of first and second electrodes intersect the plurality of third electrodes, the driving unit driving the panel unit to display an image according to a display method that includes a write period and a sustain period, by, in the sustain period, applying a voltage to the plurality of pairs of first and second electrodes and applying a voltage to the plurality of third electrodes, the PDP apparatus being characterized in that the plurality of third electrodes are divided into a plurality of groups of third electrodes, each of the plurality of groups of third electrodes include two or more third electrodes, and in the sustain period, the driving unit applies the voltage to the plurality of third electrodes such that waveforms of the voltage applied to the plurality of third electrodes differ among the plurality of groups of third electrodes in terms of a rise start timing which is set relative to a time at which the voltage applied to the plurality of pairs of first and second electrodes reaches a predetermined level.

2. The PDP apparatus of claim 1, wherein the driving unit includes:

a plurality of voltage applying circuit units which apply the voltage to the plurality of third electrodes in the sustain period; and a timing signal generation unit that outputs a signal indicating the rise start timing, in the sustain period, to each of the plurality of voltage applying circuit units.

3. The PDP apparatus of claim 1, wherein in the sustain period, the driving unit controls the voltage waveforms applied to the plurality of third electrodes so as to start rising within a time period shorter than a half cycle of a waveform of the voltage applied to the plurality of pairs of first and second electrodes.

4. The PDP apparatus of claim 3, wherein in the sustain period, the driving unit controls the voltage waveforms applied to the plurality of third electrodes so as to start rising, after a time at which the voltage applied to the plurality of pairs of first and second electrodes reaches a predetermined level, but before a time at which a discharge is generated by the voltage applied to the plurality of pairs of first and second electrodes when the voltage is assumed not to be applied to the plurality of third electrodes.

5. The PDP apparatus of claim 4, wherein in the sustain period, a voltage waveform applied to a first electrode and a voltage waveform applied to a second electrode paired with the first electrode have a same cycle, but are different from each other in terms of a timing of application, by half the cycle.

6. The PDP apparatus of claim 4, wherein in the sustain period, a voltage waveform applied to at least one of the plurality of third electrodes staffs to fall at a different timing, from a voltage waveform applied to an adjacent third electrode, which is set relative to a time at which the voltage applied to the plurality of pairs of first and second electrodes reaches a predetermined level.

7. The PDP apparatus of claim 6, wherein in the sustain period, the driving unit controls the voltage waveforms applied to the plurality of third electrodes so as to start falling within a time period shorter than a half cycle of a waveform of the voltage applied to the plurality of pairs of first and second electrodes.

8. The PDP apparatus of claim 1, wherein when the voltage waveforms applied to the plurality of third electrodes in the sustain period are expressed using a time axis and a voltage axis, at least one of a rising portion and a falling portion of each of the voltage waveforms has a gradient, and a voltage waveform applied to at least one of the plurality of third electrodes has a different gradient for at least one of a rising portion and a falling portion, from a waveform applied to an adjacent third electrode.

9. The PDP apparatus of claim 8, wherein a duration of at least one of the rising portion and the falling portion of the voltage waveform is shorter than a half cycle of a waveform of the voltage applied to the plurality of pairs of first and second electrodes.

10. The PDP apparatus of claim 1, wherein each of the voltage waveforms applied the plurality of third electrodes in the sustain period is a pulse waveform of a substantially same width.

11. The PDP apparatus of claim 1, wherein the driving unit drives the panel unit by repeating a sub-field including the write period and the sustain period, and the driving unit controls the rise start timing in units of sub-fields.

12. The PDP apparatus of claim 11, wherein two or more sub-fields constitute a sub-field group, and the driving unit controls the rise start timing in units of sub-field groups.

13. The PDP apparatus of claim 1, wherein the driving unit drives the panel unit by repeating a sub-field including the write period and the sustain period, and a plurality of sub-fields constitute a field, and the driving unit controls the rise start timing in units of fields.

14. The PDP apparatus of claim 13, wherein two or more fields constitute a field group, and the driving unit controls the rise start timing in units of field groups.

15. The PDP apparatus of claim 1, wherein the write period and the sustain period constitute a sub-field, and a plurality of sub-fields constitute a field, and for each of the voltage waveforms applied to the plurality of third electrodes, an average time period, in each sub-field or field, from a time at which the voltage applied to the plurality of pairs of first and second electrodes reaches a predetermined level to a time at which the voltage applied to the plurality of third electrodes starts to rise is substantially same.

16. The PDP apparatus of claim 1, wherein in the sustain period, a cycle of the voltage waveforms applied to the plurality of third electrodes is equal to a half cycle of a waveform of the voltage applied to the plurality of pairs of first and second electrodes.

17. The PDP apparatus of claim 1, wherein in the sustain period, a cycle of the voltage waveforms applied to the plurality of third electrodes is equal to a cycle of a waveform of the voltage applied to the plurality of pairs of first and second electrodes.

18. The PDP apparatus of claim 1, wherein in the sustain period, a cycle of the voltage waveforms applied to the plurality of third electrodes is equal to an integral multiple of a cycle of a waveform of the voltage applied to the plurality of pairs of first and second electrodes.

19. A driving method for a PDP apparatus including a panel unit including a first substrate on which a plurality of pairs of first and second electrodes are formed and a second substrate on which a plurality of third electrodes are formed, the first substrate and the second substrate being opposed to each other with a discharge space therebetween so as to form discharge cells at areas where the plurality of pairs of first and second electrodes intersect the plurality of third electrodes, the driving method including a write period and a sustain period, and being used to display an image, by, in the sustain period, applying a voltage to the plurality of pairs of first and second electrodes and applying a voltage to the plurality of third electrodes, the driving method being characterized in that the plurality of third electrodes are divided into a plurality of groups of third electrodes, each of the plurality of groups of third electrodes include two or more third electrodes, and in the sustain period, the voltage is applied to the plurality of third electrodes such that the waveforms of the voltage applied to the plurality of third electrodes differ among the plurality of groups of third electrodes in terms of a rise start timing which is set relative to a time at which the voltage applied to the plurality of pairs of first and second electrodes reaches a predetermined level.

20. The driving method of claim 19, wherein a voltage applying circuit that applies a voltage is connected to each of the plurality of groups of third electrodes, and in the sustain period, the rise start timing is controlled in such a manner that a signal indicating the rise start timing is input into the voltage applying circuit.

21. The driving method of claim 19, wherein in the sustain period, the voltage waveforms applied to the plurality of third electrodes are controlled so as to start rising within a time period shorter than a half cycle of a waveform of the voltage applied to the plurality of pairs of first and second electrodes.

22. The driving method of claim 21, wherein in the sustain period, the voltage waveforms applied to the plurality of third electrodes are controlled so as to start rising, after a time at which the voltage applied to the plurality of pairs of first and second electrodes reaches a predetermined level, but before a time at which a discharge is generated by the voltage applied to the plurality of pairs of first and second electrodes when the voltage is assumed not to be applied to the plurality of third electrodes.

23. The driving method of claim 22, wherein in the sustain period, a voltage waveform applied to a first electrode and a voltage waveform applied to a second electrode paired with the first electrode have a same cycle, but are different from each other in terms of a timing of application, by half the cycle.

24. The driving method of claim 19, wherein in the sustain period, a voltage waveform applied to at least one of the plurality of third electrodes starts to fall at a different timing, from a voltage waveform applied to an adjacent third electrode, which is set relative to a time at which the voltage applied to the plurality of pairs of first and second electrodes reaches a predetermined level.

25. The driving method of claim 24, wherein in the sustain period, the voltage waveforms applied to the plurality of third electrodes are controlled so as to start falling within a time period shorter than a half cycle of a waveform of the voltage applied to the plurality of pairs of first and second electrodes.

26. The driving method of claim 19, wherein when the voltage waveforms applied to the plurality of third electrodes in the sustain period are expressed using a time axis and a voltage axis, at least one of a rising portion and a falling portion of each of the voltage waveforms has a gradient, and a voltage waveform applied to at least one of the plurality of third electrodes has a different gradient for at least one of a rising portion and a falling portion, from a waveform applied to an adjacent third electrode.

27. The driving method of claim 26, wherein a duration of at least one of the rising portion and the falling portion of the voltage waveform is shorter than a half cycle of a waveform of the voltage applied to the plurality of pairs of first and second electrodes.

28. The driving method of claim 19, wherein each of the voltage waveforms applied the plurality of third electrodes in the sustain period is a pulse waveform of a substantially same width.

29. The driving method of claim 19, wherein the panel unit is driven by repeating a sub-field including the write period and the sustain period, and the rise start timing is controlled in units of sub-fields.

30. The driving method of claim 29, wherein two or more sub-fields constitute a sub-field group, and the rise start timing is controlled in units of sub-field groups.

31. The driving method of claim 19, wherein the panel unit is driven by repeating a sub-field including the write period and the sustain period, and a plurality of sub-fields constitute a field, and the rise start timing is controlled in units of fields.

32. The driving method of claim 31, wherein two or more fields constitute a field group, and the rise start timing is controlled in units of field groups.

33. The driving method of claim 19, wherein the write period and the sustain period constitute a sub-field, and a plurality of sub-fields constitute a field, and for each of the voltage waveforms applied to the plurality of third electrodes, an average time period, in each sub-field or field, from a time at which the voltage applied to the plurality of pairs of first and second electrodes reaches a predetermined level to a time at which the voltage applied to the plurality of third electrodes starts to rise is substantially same.

34. The driving method of claim 19, wherein in the sustain period, a cycle of the voltage waveforms applied to the plurality of third electrodes is equal to a half cycle of a waveform of the voltage applied to the plurality of pairs of first and second electrodes.

35. The driving method of claim 19, wherein in the sustain period, a cycle of the voltage waveforms applied to the plurality of third electrodes is equal to a cycle of a waveform of the voltage applied to the plurality of pairs of first and second electrodes.

36. The driving method of claim 19, wherein in the sustain period, a cycle of the voltage waveforms applied to the plurality of third electrodes is equal to an integral multiple of a cycle of a waveform of the voltage applied to the plurality of pairs of first and second electrodes.

37. The PDP apparatus of claim 1 wherein the voltage applied to the plurality of pairs of first and second electrodes in the sustain period has pulse waveforms, and the driving unit applies the voltage to the plurality of third electrodes in the sustain period in synchronization with each pulse applied to the plurality of pairs of first and second electrodes.

38. The PDP apparatus of claim 1 wherein in the sustain period, a plurality of discharge currents flow through the plurality of pairs of first and second electrodes, the plurality of discharge currents differing in terms of start timing and peak timing.

* * * * *

UNITED STATES PATENT AND TRADEMARK OFFICE

CERTIFICATE OF CORRECTION

PATENT NO. : 7,589,696 B2
APPLICATION NO. : 10/533840
DATED : September 15, 2009
INVENTOR(S) : Hashimoto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1111 days.

Signed and Sealed this

Twenty-first Day of September, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,589,696 B2
APPLICATION NO. : 10/533840
DATED : September 15, 2009
INVENTOR(S) : Hashimoto et al.

It is certified that error appears in the above-identified patent and that said Letters Patent is hereby corrected as shown below:

Claim 6, Column 18, line 44: “claim 4” should be --claim 1--;
Claim 6, Column 18, line 46: “staffs” should be --starts--.

Signed and Sealed this
Twenty-fourth Day of April, 2012

David J. Kappos

David J. Kappos
*Director of the United States Patent and Trademark Office*